US011060821B2

(12) United States Patent
Cincotti et al.

(10) Patent No.: US 11,060,821 B2
(45) Date of Patent: Jul. 13, 2021

(54) CAMOUFLAGE PATTERNS, ARRANGEMENTS AND METHODS FOR MAKING THE SAME

(71) Applicant: Scientiam Solutions, Inc., Tyler, TX (US)

(72) Inventors: K. Dominic Cincotti, Fayetteville, NC (US); Trevor J. Kracker, Lumberton, NC (US)

(73) Assignee: Scientiam Solutions, Inc., Tyler, TX (US)

( * ) Notice: Subject to any disclaimer, the term of this patent is extended or adjusted under 35 U.S.C. 154(b) by 347 days.

(21) Appl. No.: 15/722,123

(22) Filed: Oct. 2, 2017

(65) Prior Publication Data

US 2018/0094905 A1 Apr. 5, 2018

Related U.S. Application Data

(63) Continuation of application No. 12/221,540, filed on Aug. 4, 2008, now abandoned.

(60) Provisional application No. 60/963,020, filed on Aug. 2, 2007.

(51) Int. Cl.
*F41H 3/00* (2006.01)

(52) U.S. Cl.
CPC ..... *F41H 3/00* (2013.01); *Y10T 428/24802* (2015.01)

(58) Field of Classification Search
CPC ..... F41H 3/00; Y10T 428/24802
See application file for complete search history.

(56) References Cited

U.S. PATENT DOCUMENTS

2002/0110652 A1* 8/2002 Conk ..... B44F 1/10 428/15
2005/0230963 A1* 10/2005 McDowell ..... B42D 1/00 283/81
2005/0276955 A1* 12/2005 Tooley ..... A41D 13/00 428/195.1

OTHER PUBLICATIONS

Realtree Hardwoods HD Camo (Realtree Company Timeline 2002, Hardwoods HD Camo); cited in parent U.S. Appl. No. 12/221,540 (Year: 2002).*

(Continued)

*Primary Examiner* — Laura C Powers
(74) *Attorney, Agent, or Firm* — NK Patent Law

(57) ABSTRACT

A site-specific photographic camouflage arrangement and method for making the same are provided. The site-specific photographic camouflage arrangement includes a digital photographic image and distorting disruptive patterns placed on the digital photographic image to create visual confusion to disguise the recognizable form of a camouflaged object by breaking up its outline.

22 Claims, 29 Drawing Sheets

(56) References Cited

OTHER PUBLICATIONS

Digital Artform History of Mosaics (http://www.digitalartform.com/archives/2004/12/history_of_phot.html; Dec. 12, 2004); cited in parent U.S. Appl. No. 12/224,540 (Year: 2004).*

RealTree Hardwoods® HD CamoTM (http://www.realtree.com/patterns/guide-hardwoods.tpl via Internet Wayback Machine Jun. 19, 2006 https://web.archive.org/web/20060619210426/http://www.realtree.com/patterns/guide-hardwoods.tpl (Year: 2006).*

A. "Create photo mosaics with free photo mosaic software" http://www.andybrain.com/archive/photo-mosaic-software.htm via Internet Wayback Machine https://web.archive.org/web/20060825124755/http://www.andybrain.com/archive/photo-mosaic-software.htm, Aug. 25, 2006) (Year: 2006).*

* cited by examiner

CAMOUFLAGE PATTERNS, ARRANGEMENTS AND METHODS FOR MAKING THE SAME

RELATED APPLICATIONS

The presently disclosed subject matter is a continuation of U.S. patent application Ser. No. 12/221,540, filed Aug. 4, 2008, entitled "Camouflage patterns, arrangements and methods for making the same", which claims the benefit of U.S. Provisional Patent Application Ser. No. 60/963,020, filed Aug. 2, 2007, entitled "Site-specific camouflage arrangements and methods for making the same"; the disclosures of which are incorporated herein by reference in their entirety.

TECHNICAL FIELD

Camouflage patterns, arrangements and methods for making the same are provided. In particular, site-specific photographic camouflage patterns, arrangements and methods of making the same are provide that create visual confusion that can be utilized to disguise the recognizable form of an object by breaking up its outline using unnatural magnifications and distortions of the photo-image and disruptive patterns.

BACKGROUND

In war, the function of camouflage is very simple: it is used to hide individuals and their equipment from the enemy. People have been using camouflage in some form or another from the beginning of human civilization. In fact, the basic idea of camouflage predates humans entirely. It comes from the natural adaptations that let animals blend in with their environment. Generally, camouflage material is colored with dull hues that match the predominant colors of the surrounding environment. In jungle warfare, camouflage is typically green and brown, to match the forest foliage and dirt. In the desert, military forces use a range of tan colors. Camouflage for snowy climates is colored with whites and grays.

Contrary to popular belief, camouflage does not work by making the wearer or object invisible. Rather, it works by creating visual confusion and thereby disguises a recognizable form by breaking up its outline. The reason for using camouflage is that it is visually disruptive. The meandering lines of a mottled camouflage pattern help hide the contour, or outline, of the body. When looking at a piece of mottled camouflage in a matching environment, the brain naturally "connects" the lines of the colored blotches with the lines of the trees, ground, leaves and shadows. This affects the way a person perceives and recognizes the individual or object hidden by camouflage.

Human perception naturally categorizes things in the world as separate objects. When a person looks at a scene, the person is gathering an immense amount of information with their eyes and other senses. In order for the person's conscious mind to make any sense out of this information, the person's brain has to break it down into component parts. When the brain perceives a long, vertical area of brown with green blotches connected to it, the person perceives a tree. Further, when the brain perceives many, many individual trees in a given area, the person perceives a forest.

One thing the brain is always looking for when analyzing visual information is continuity. Take a stack of twelve blocks, for instance. If all of the blocks are colored red, a person perceives the pile as one unit. But if the bottom six blocks are red and the top six blocks are blue, the person may perceive the pile as two separate units: a stack of blue blocks on top of a stack of red blocks. If the blue blocks and red blocks were randomly mixed together, a person would not group them into colored units at all. Human perception tends to recognize something as a separate object if it has one continuous color, so a person is much more likely to stand out when wearing a single color than when wearing a multiplicity of colors. In a jungle environment, a person perceives the multiplicity of colors in camouflage material as many small things that are component parts of the surrounding foliage.

The importance of proper camouflage is stressed in basic military training. Commanders realize that proper camouflage directly enhances the survival of their men. Additionally, camouflage patterns disrupt the normal appearance of the equipment, making the recognition of high-value targets more difficult.

In the late 1970s, the Marine Corps began painting its equipment in camouflage patterns rather than the basic green color. There are three camouflage color patterns used today. They are Standard (black/green/brown), Desert (tan), and Winter Snow (black/white/brown). The pattern choice for the Fleet Marine Force depends on where the Unified Commander plans to employ the Marines, or other services, in his theater of operations. Due to requirements that the certain units be able to respond to a wide spectrum of world-wide crisis, the Marine Corps uses the Standard color for its major end items.

On Aug. 6, 1990, elements of a Marine Expeditionary Force began preparations for deployment to Saudi Arabia. During mission analysis, the determination was made to change the camouflage color of the equipment from green to desert tan. Consultation with the depot-level maintenance experts revealed that the depots could not handle the enormous volume of painting required. Additionally, the materials required for the painting task were not available in sufficient quantities. As various staffs worked diligently to find a suitable alternative to the green camouflage paint scheme, the evidence indicated that this was a service-wide problem. Specifically, the problem is that no suitable method exists to rapidly change the camouflage color on military equipment. The cause of the problem is exacerbated by the requirement to use chemical agent resistant coating ("CARC"). The solution to this problem requires the Department of Defense to discontinue the use of CARC paint and to allow local facilities to paint their equipment when operational necessity dictates.

While it appears that CARC is the ideal paint for camouflage and chemical protection, it is important to realize this relationship directly contributes to the problem. Several disadvantages are obvious when attempting to rapidly change color. CARC paint is considered environmentally hazardous, and its application requires environmental Protection Agency ("EPA") approved safety equipment and facilities. The EPA regulations restrict the use of CARC to one quart per site per day. Only approved facilities, such as depot-level maintenance facilities can dispense CARC in volume. This restriction on volume painting is attributed to the amount of volatile organic compounds released into the atmosphere when spraying. Further, CARC is expensive and has a limited shelf life. In fact, CARC is approximately four times more expensive than a low emission alkyd or polyurethane paint. Additionally, the camouflage created from paints is not that effective. With the advent of electronic optical devices, such painting schemes are even less effective.

Thus, a need exists for a camouflage arrangement and method for making the same that can provide excellent visual confusion that can be utilized to disguise the recognizable form of an object by breaking up its outline. Further, it can be beneficial if the camouflage provides the user with the opportunity to rapidly change the camouflage scheme.

SUMMARY

It is an object of the presently disclosed subject matter to provide photographic camouflage patterns, arrangements and methods for making the same.

The creation and utilization of photographic camouflage patterns or arrangements to create visual confusion can be used to disguise the recognizable form of the camouflaged objects by breaking up the objects' outline through the use of unnatural magnifications and distortions of the photo-image. In one embodiment, the method for constructing the camouflage arrangements can comprise procuring site-specific photographic images and manipulating the site-specific photographic images to produce site-specific camouflage, thereby providing increased concealment to an object. In one particular embodiment, the camouflage arrangement can be transferred to a substrate that can then be wrapped around or applied to a physical item, such as a vehicle or other transportation means as well as a structure, building, weapon or other equipment.

In one aspect, a site-specific photographic image can be manipulated by adding one or more disruptive patterns thereon to achieve a disruptive effect that aids in the cause of visual confusion by inhibiting normal depth perception. The disruptive pattern can contain one or more colors. Alternatively, the disruptive patterns can include the positioning of images or sections having different focal lengths layered over a site-specific photographic image. Further, the camouflage pattern can be a plurality of disruptive patterns with each disruptive pattern including an image with a different focal length. These processes can disrupt the normal environment of the site-specific photographic images to disrupt vision rather than attempting to create a camouflage pattern or arrangement to match the photographic image.

An object of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

The patent or application file contains at least one drawing executed in color. Copies of this patent or application with color drawing(s) will be provided by the Patent and Trademark Office upon request and payment of necessary fee.

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1A:
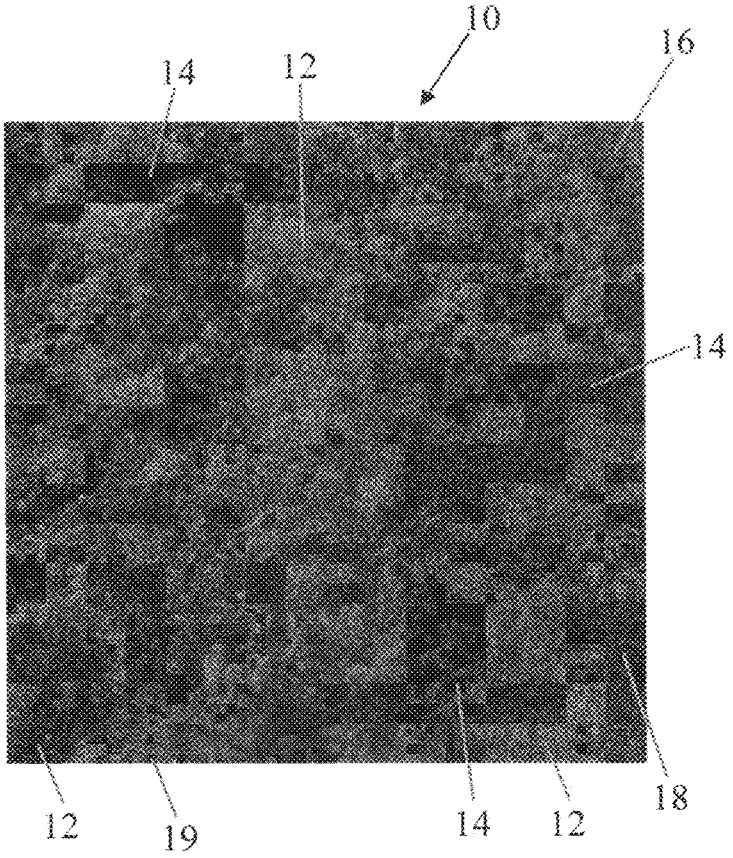
FIGS. 1A and 1B illustrate embodiments of a camouflage pattern or arrangement according to the present subject matter.

Reference will now be made in detail to the description of the present subject matter, one or more examples of which are shown in the Figures. Each example is provided to explain the subject matter and not as a limitation. In fact, features illustrated or described as part of one embodiment can be used in another embodiment to yield still a further embodiment. It is intended that the present subject matter cover such modifications and variations.

"Site-specific" as used herein means a specific local terrain, nautical position, or airspace where a physical item will be located or operating, or the environmental characteristics which would be found in the intended operating environment of the physical item.

"Disruptive pattern" as used herein means a pattern of shapes that when configured on an image will cause visual confusion.

"Distortions," "distorting," and variations thereof as used herein means the changing of at least a portion of an image by manipulating the focal lengths within those portions of the image, adding to a first image a portion of the image or a portion of different image that has a different focal length than the first image, or adding shapes of color that change the appearance of the image. Focal lengths can include improper focal lengths that cause at least a portion of the image to appear to be out of focus.

"Focal lengths" as used herein means the distance at which an image will come into visual focus either by a human observer or through electronic, electromechanical and/or optical methods and devices. Focal lengths can include improper focal lengths that cause at least a portion of the image to appear to be out of focus.

"Image-editing program" as used herein means a computer program used to edit or change an image. Examples include Adobe PHOTOSHOP®, PAINT.NET® and PICASA®.

"Image" as used herein means the optical counterpart of an object or environment produced by graphical drawing by a person, a device (such as a computer) or a combination thereof. The optical counterpart of the object can also be produced by an optical device electromechanical device or electronic device. As used herein, "image" can be used to refer to a whole image, for example, a photographic image as taken by a photographic device, or a portion thereof.

The process described herein for developing a camouflage pattern. The camouflage pattern can be transferred to a substrate. The substrate may include a vinyl wrapping or other adhesive material for covering physical items. Such physical items can include, but are not limited to any and all types of vehicles (land, air and sea, and rail/manned & unmanned), aircraft, watercraft, structures, buildings, pipes and piping, equipment, weapons, hardware, and other items used for military or other purposes where camouflage can enhance its effective use or where the need for camouflage concealment or deception exists.

The camouflage patterns and processes can use photo-digital processes to create the camouflage patterns. The variations of the processes described herein are distinguishable from any previously identified photo-digital camouflages processes in numerous ways. For example, these processes seek to disrupt the normal environment of the site-specific photographs to disrupt vision rather than attempting to create a camouflage pattern to match the photograph or appear to be part of the environment displayed on the photograph. Also, the various camouflage patterns described herein create distinct camouflage patterns for different or multiple visual angles or perspectives of the same object in order to maximize stealth or concealment from each angle. Rather than attempting to create a camouflage pattern that is realistic or similar to what is displayed in a photograph, the camouflage patterns described herein are attempting to distort the image to disrupt vision thereby making the camouflage pattern more effective.

This process can begin with a photographic image of a specific local terrain, nautical position, or airspace where a physical item will be located or operating. Alternatively, the photographic image can contain environmental characteristics which would be found in the intended operating environment of the physical item instead of being a specific image from the specific location of the physical item. As stated above, the physical item can include, but is not limited to any and all types of vehicles (land, air and sea, and rail/manned & unmanned), aircraft, watercraft, structures, buildings, pipes and piping, equipment, weapons, hardware, and other items used for military or other purposes.

Figure 1B:
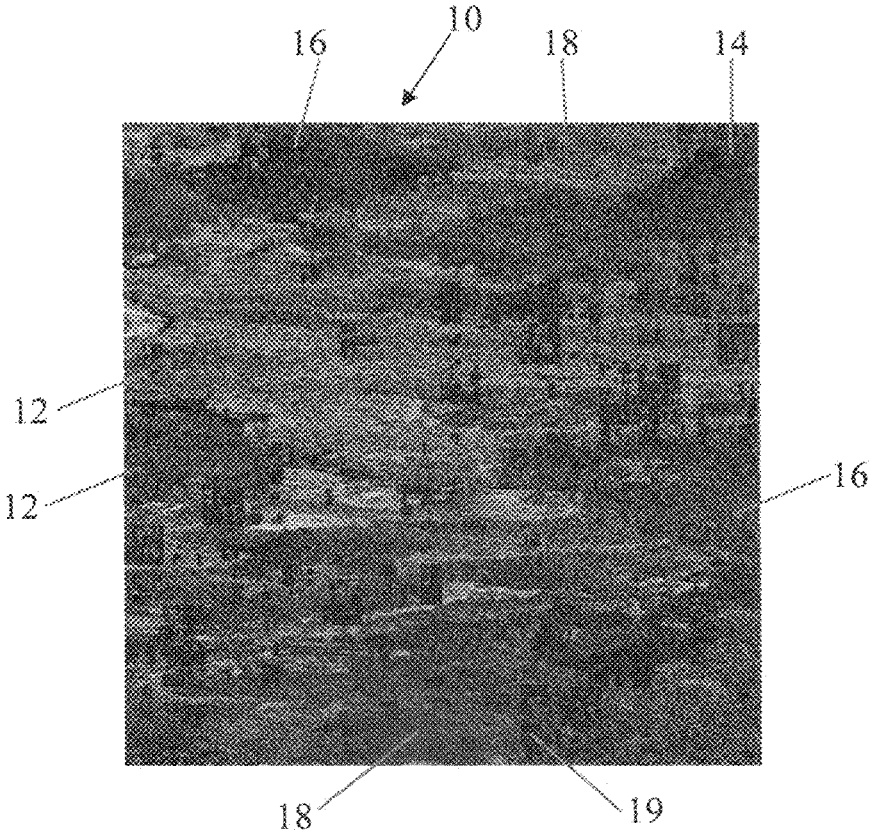

The photographic image can be digital and can then be manipulated such that site-specific photographic camouflage contains unnaturally occurring image distortions to aid in inhibiting the ability to easily distinguish proper depth of field perception. For example, FIGS. 1A and 1B illustrate different camouflage patterns generally 10, each of which includes portions or areas 12 of one or more photographic images that are site-specific for the intended operating environment in which the camouflage is to be used. The areas 12 can have different magnifications having different focal lengths creating distortions that are configured in disruptive patterns 14. For example, a specific area 16 of the areas 12 of one or more photographic images can be in focus at one focal length, while another specific area 18 of the areas 12 of one or more photographic images can have a different focal length that makes it more magnified. Further, micropatterns 19 can be added to further distort the image. The disruptive patterns 14 can be any shape from a structured shape to a generally amorphous shape as can be created by a pixel matrix.

Further, the camouflage 10 can have disruptive patterns having areas with an improper focal length that creates a blurred distortion that appears to be out of visual focus. For example, specific area 18 of the areas 12 of one or more photographic images can include portions of images that have an improper focal length and are slightly out of focus. Such disruptive patterns with blurred distortions can create further visual confusion for an observer and/or for an electronic or optical device. For example, for a physical item that contains images having multiple focal lengths and/or image portions having improper focal lengths that creates an out of focus portion beside an image portion that has a proper focal length and is in focus, an optical or electronic device that detects such a physical item will have difficulty focusing on the physical item and/or determining a correct distance between the device and the physical item. Such visual confusion aids in camouflaging and protecting the physical item.

Figure 2A:
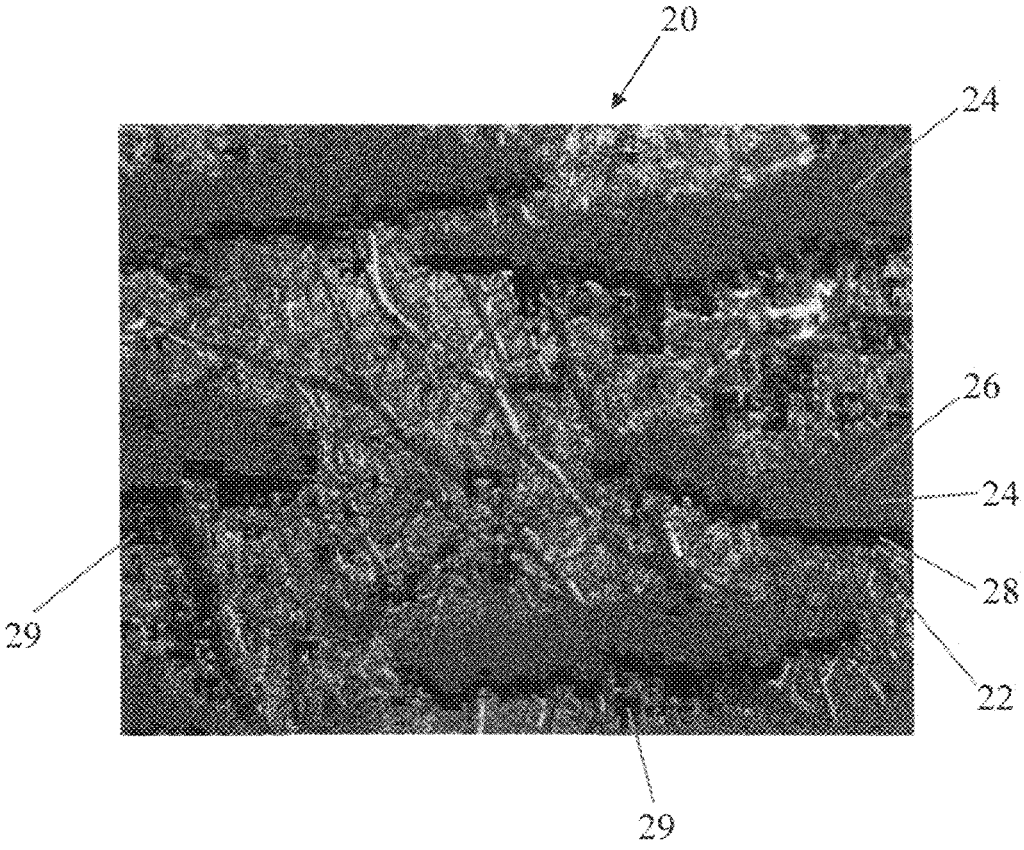
FIGS. 2A and 2B illustrate other embodiments of a camouflage pattern or arrangement according to the present subject matter.
Figure 2B:
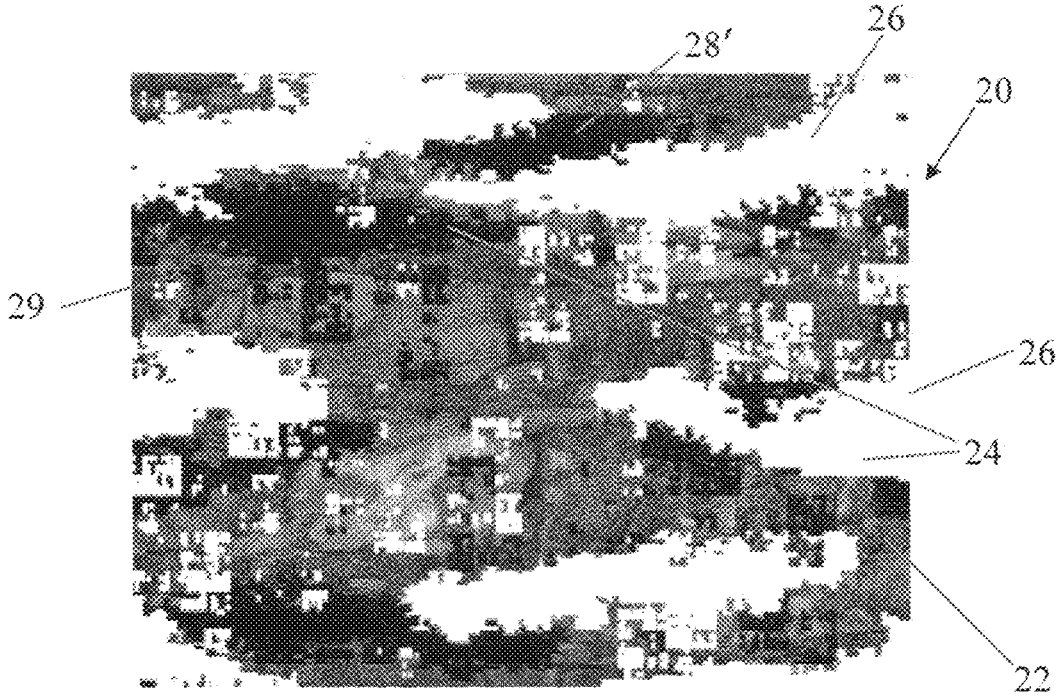

FIGS. 2A and 2B illustrate other examples of a camouflage pattern generally 20, each of which includes photographic image 22 that is site-specific to the intended operating environment in which the camouflage is to be used. One or more disruptive patterns 24 of one or more colors selected from a range of colors can be placed over the photographic image 22 to create distortions. The range of colors can come from the palate of colors in the photographic image and/or an operating environment in which the camouflage is intended to be used. For example, the disruptive pattern 24 as shown in FIG. 2A can include a first portion, or top portion, 26 that overlays a shadow portion 28. Alternatively, the disruptive patterns 24 can include a first disruptive pattern 26 and a second disruptive pattern 28' that may overlap some, but do not necessarily mirror each other as shown in FIG. 2B. Further, micropatterns 29 can be added to further distort the photographic image. There at least two disruptive patterns can be included in the camouflage pattern. The disruptive patterns 24 can be any shape from a structured shape to a generally amorphous shape. The randomness of such shapes may be limited by the pixel matrix of the image, if it is a digital image. Placement of unnaturally occurring colored disruptive patterns and micro patterns on the original site-specific photographic image disrupts the contour of the camouflaged object and breaks up the visual pattern and distinguishable shape of the object.

Figure 3:
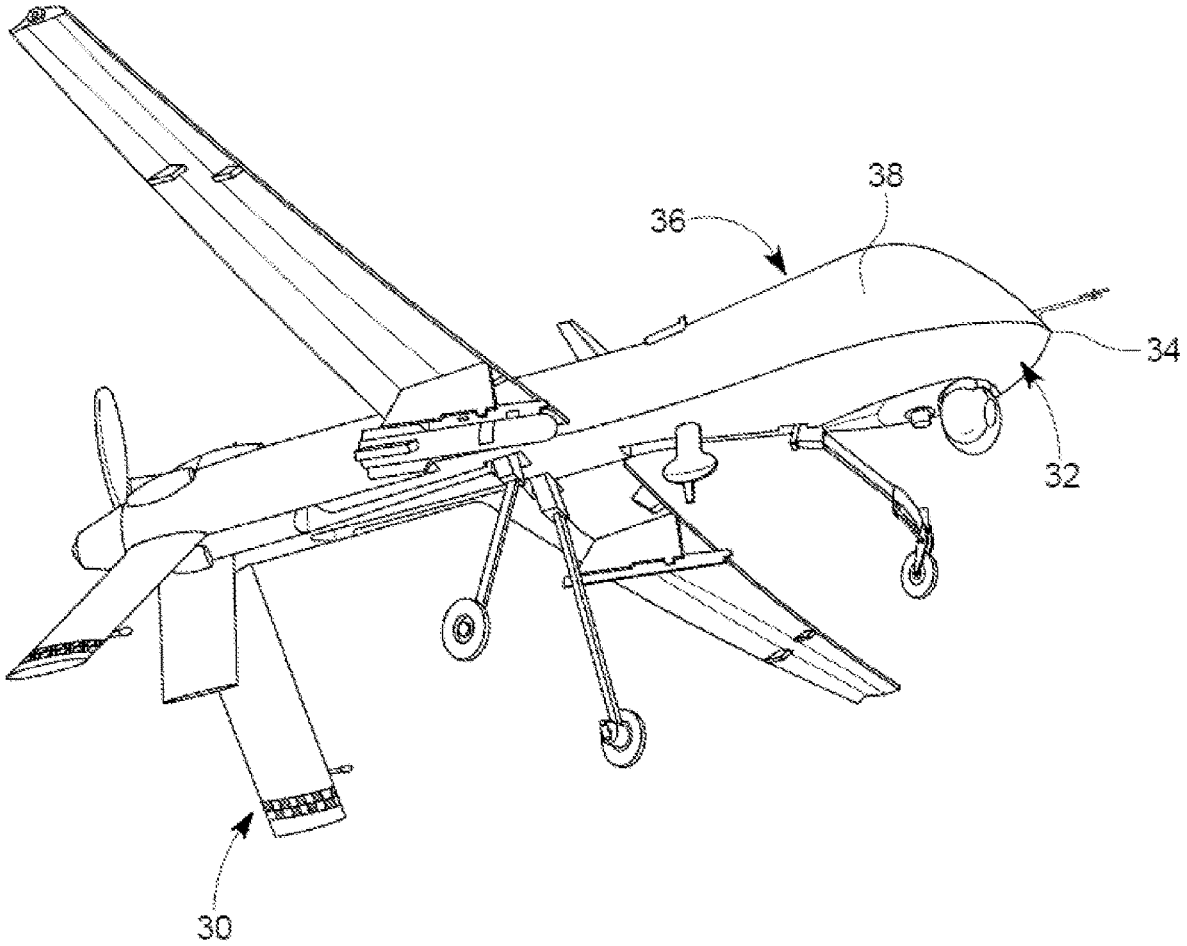
FIG. 3 illustrates a perspective view of a physical item having embodiments of a camouflage pattern or arrangement placed thereon according to the present subject matter.

When applied, the camouflage can create multiple viewing angles. For example, as shown in FIG. 3, a drone plane, generally 30, can have an underside 32 that has a site-specific visually distorted blue sky image 34 thereon and a topside 36 that has site-specific visually distorted image 38 having the characteristics of the surrounding landscape as looking down from above. The image 38 of the drone plane 30 in FIG. 3 has on its top side 36 unnaturally occurring magnifications and disruptions of site-specific photo images similar to the camouflage 10 of FIG. 1B.

Through the use of micropatterns and disruptive patterns of colored shapes and/or side-by-side areas within the camouflage that contain photo images at competing or contrasting focal lengths, a visual confusion and a disruption, or breaking up of the outline of the camouflaged object can be achieved. In this manner, the camouflage 10, 20 can be created with a generally seamless continuation of other naturally occurring features and landscapes that continue into the horizon. A synthesized but realistic perspective arrangement in a given environment is not necessarily sought. Rather, a principal purpose is to cause visual confusion by disguising and breaking up the recognizable form of the object. Another purpose is to inhibit depth perception by interfering with primary ways we perceive depth.

For example, depth from focus can be inhibited. The lens of the eye can change its shape to bring objects at different distances into focus. Knowing at what distance the lens is focused when viewing an object means knowing the approximate distance to that object. The discontinuous pattern of the camouflage creates no regular continuously repeatable pattern coinciding with the natural environment. This jumble of shapes goes against the Gestalt law of continuity, and makes it harder to see.

Another example, depth from relative size can be inhibited. An automobile that is close to a person looks larger to that person than one that is far away; the human visual system exploits the relative size of similar (or familiar) objects to judge distance. The pattern of differing focal differences within the created pattern described herein creates visual confusion by making it harder to judge relative size.

Depth perceived from motion can also be inhibited. A form of depth from motion, kinetic depth perception, is determined by dynamically changing object size. As objects in motion become smaller, they appear to recede into the distance or move farther away; objects in motion that appear to be getting larger seem to be coming closer. This is a form of kinetic depth perception. Using kinetic depth perception enables the brain to calculate time to crash distance (TTC) at a particular velocity. When driving, we are constantly judging the dynamically changing headway (TIC) by kinetic depth perception. The patterns described herein confuse or complicate the determination of kinetic depth perception by the inherent differing magnifications or disruptions rendering the true object size more difficult to perceive, and thereby interfering with kinetic depth perception.

Referring to FIGS. 4-10, a process for creating a camouflage from a site-specific digital photographic image using colored disruptive patterns is described in detail. First, a digital photographic image 40 is procured or obtained that can be used in an intended operating environment. For example, suitable high megapixel digital still photographs of the specific terrain, nautical position, or airspace which the user will be operating can be acquired. These digital still photographs can be obtained in different manners and using different equipment. For example, the digital still photographs can be obtained through digital still cameras, high definition and standard definition video cameras, or satellite imagery.

Once obtained, the digital photographic image 40 in the form of a high megapixel digital still photograph, for example, is the starting point for the camouflage, concealment or deception pattern to be created and later applied to a physical item such as a military vehicle (land, air or sea), structure, weapon, hardware, fabric, netting, mesh, or equipment. A suitable digital photographic image or images 40 can contain a very precise match to the specific operating environment by being high megapixel photo duplicates of the environment. Alternatively, a suitable digital photographic image or images 40 can contain environmental characteristics which would be found in the intended operating environment of the physical item The photographs can be from different viewing perspectives to allow the capability to design appropriate camouflage that will be effective from different viewing perspectives (when viewed from above, on any side, or when necessary viewed from below). For example, as illustrated in FIG. 4, if the physical item to be camouflaged is to reside or operate within a desert environment, the digital photographic image 40 can reflect the general characteristics of a desert environment or can be from the actual desert location in which the camouflaged physical item will reside and/or operate.

Figure 4:
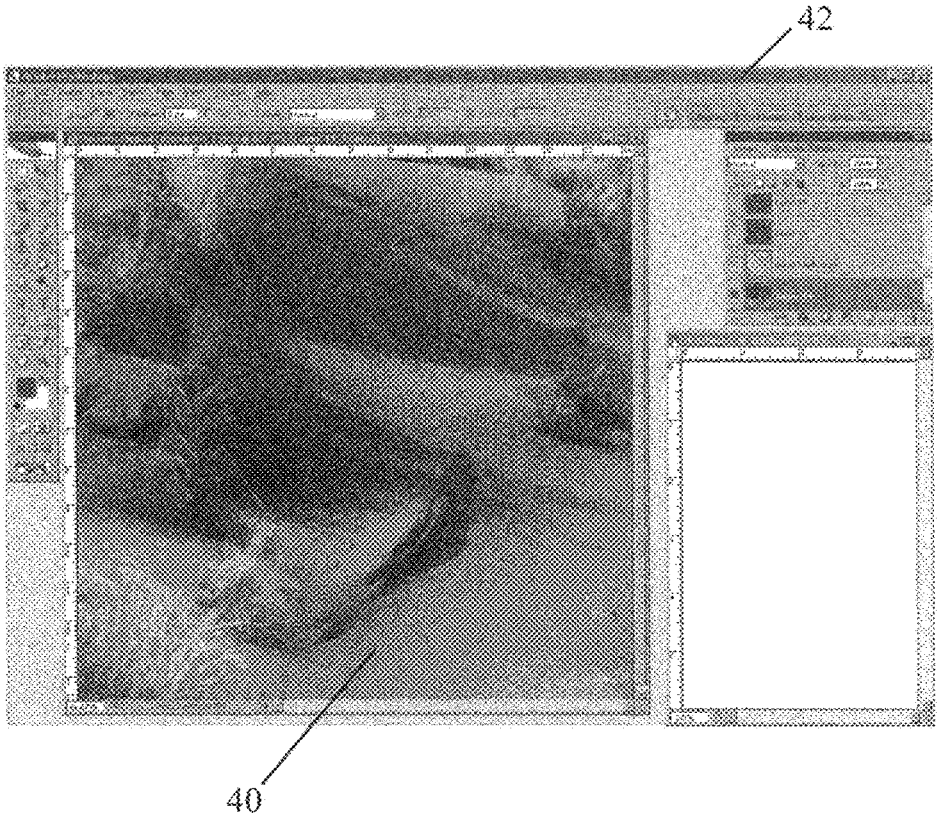
FIGS. 4-10 illustrate steps for creating embodiments of a camouflage pattern or arrangement according to the present subject matter.

The digital photographic image 40 is opened on the computer in an image-editing program 42 as shown in FIG. 4 so that the digital photographic image 40 can be enhanced to create a camouflage pattern for concealment or deception purposes. The image-editing program can be, for example, PHOTOSHOP® offered by Adobe Systems Incorporated, San Jose Calif. Other image-editing programs can include equivalent photo manipulation and editing software programs such as PAINT.NET® and PICASA®, or the like, or in the case of video footage the image-editing programs can include appropriate video editing software programs that will produce a digital still frame photographic image.

Figure 5:
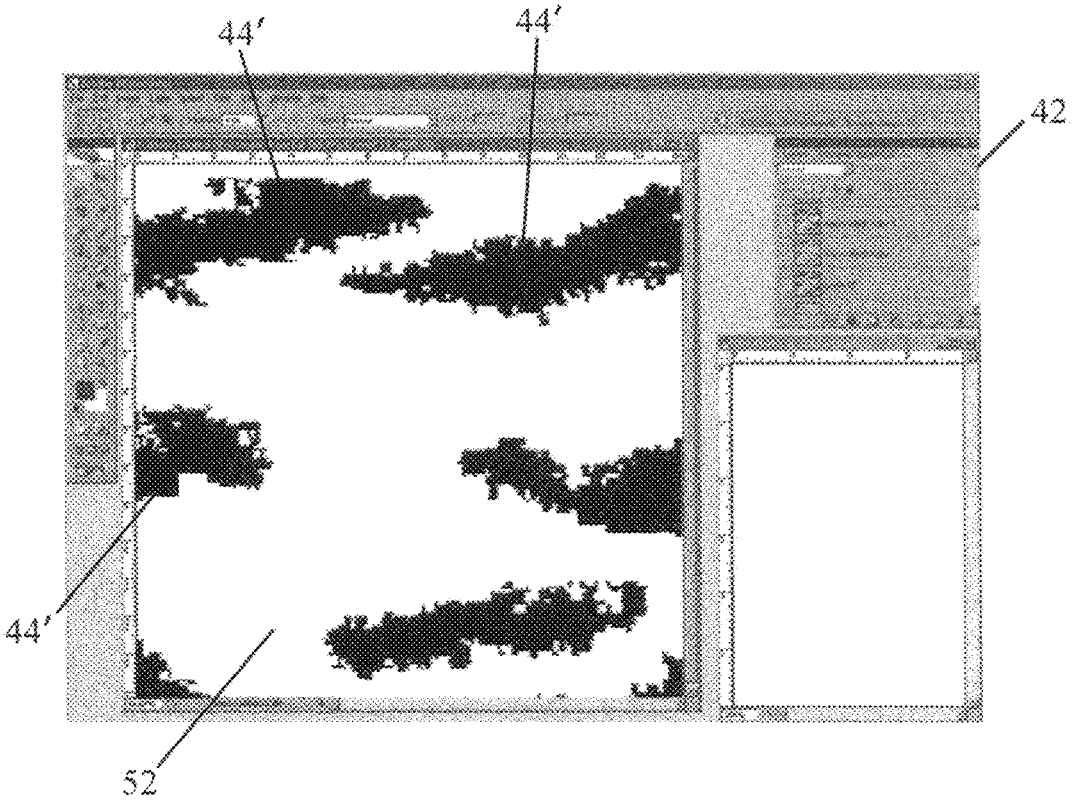
Figure 6:
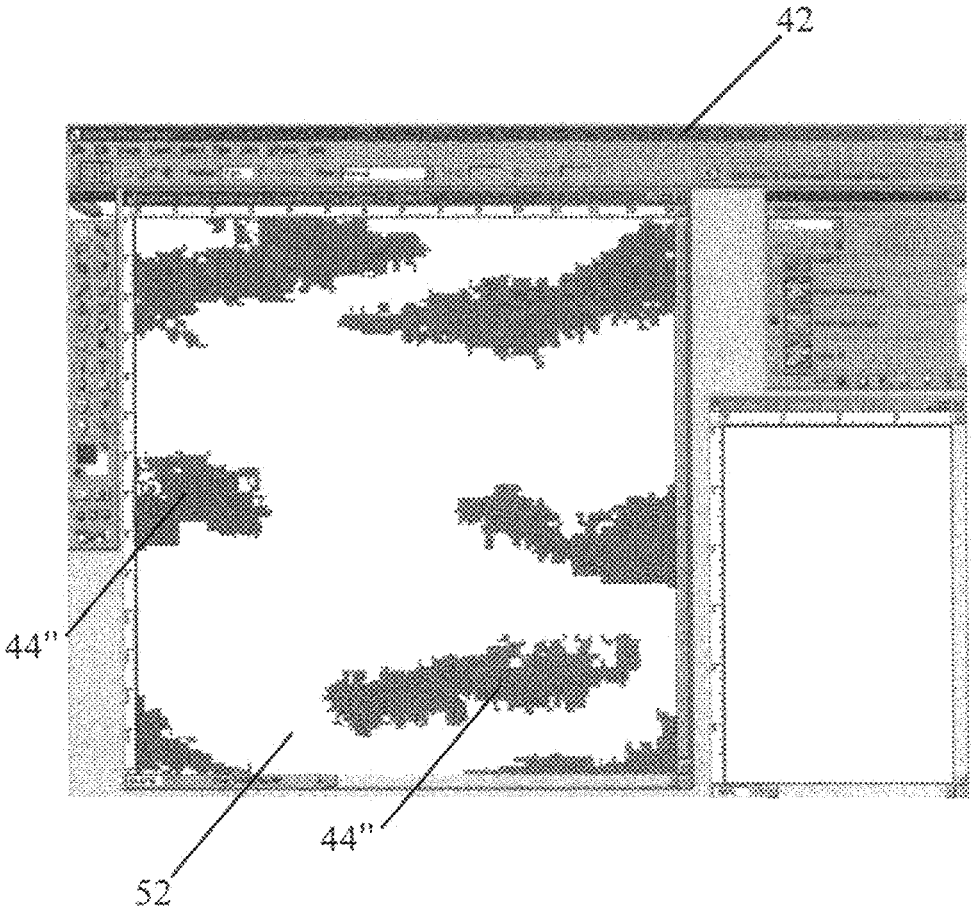
Figure 7:
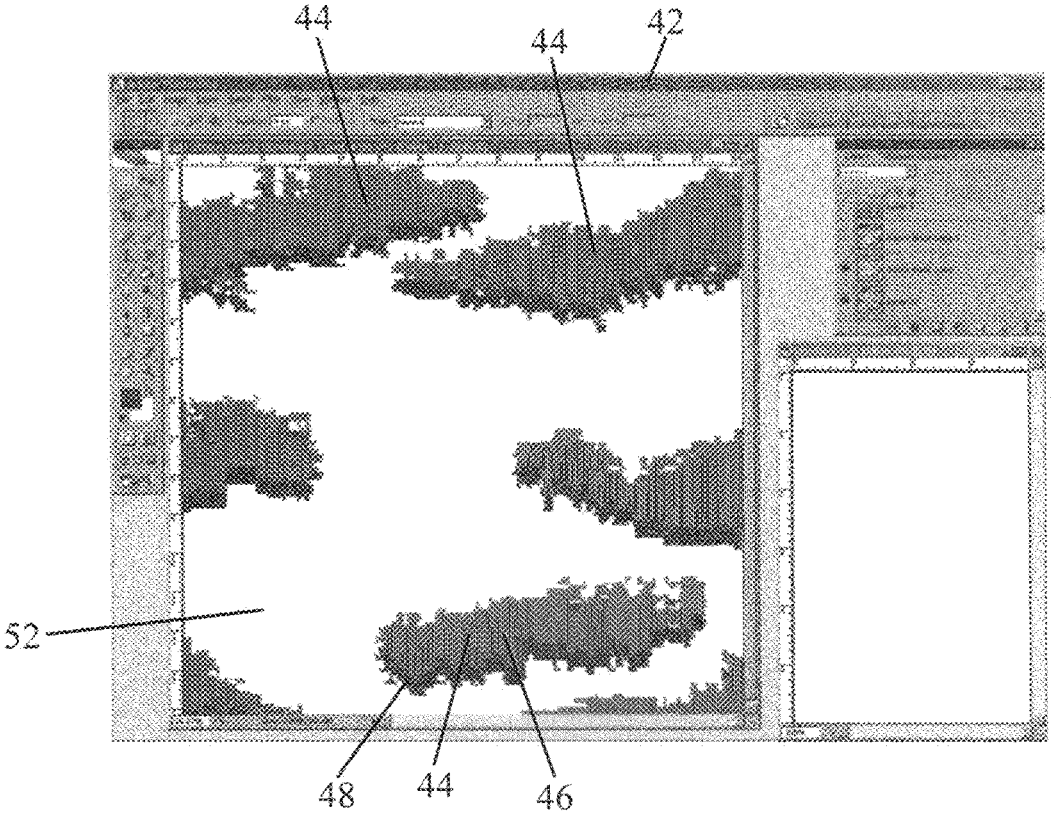

Next, the digital photographic image 40 can be manipulated by adding "disruptive patterns" to break-up or hide the contour of the physical item to be camouflaged or concealed as an aid in causing visual confusion. As shown in FIGS. 5-7, the imaging-editing program 42 can be used to generate a disruptive pattern 44 (see FIG. 7) on a gray scale 52 that can be placed over the digital photographic image 40, As shown in FIG. 5, shapes 44' can be generated in the image editing program 42 to create the foundation of the disruptive pattern 44 (see FIG. 7). The disruptive pattern 44 can contain any shapes. As shown in FIG. 5, the shapes 44' of the disruptive pattern can be generally amorphous. Alternatively, in some embodiments, the shapes 44' can be specific geometrical structures.

The shapes 44' of the disruptive pattern shown in FIG. 5 can be of a size that is relative to the scale and size of the digital photographic image 40 (see FIG. 4) so as to not overwhelm the digital photographic image 40. In a similar manner, the proximity, or distance, between the shapes 44' of the disruptive pattern, can be close enough so as to facilitate the creation of visual confusion when positioned on the digital photographic image 40, but far enough apart from each other to not overwhelm the digital photographic image 40. For this reason, the size and shape of the shapes 44' can affect the number of shapes 44' within a given disruptive pattern.

The shapes 44' of the disruptive pattern shown in FIG. 5 can be colored to create colored shapes 44" as shown FIG. 6. The one or more colors can be selected from a range of colors suitable for the intended operating environment in which the camouflage is to be used. For example, the one or more colors can be selected from a range of colors from the digital photographic image 40 and/or the operating environment in which the camouflage is intended to be used. More than one color can be used to color the different shapes. For example, some of the shapes can be one color and other shapes can be another color as shown in FIG. 28.

Figure 9:
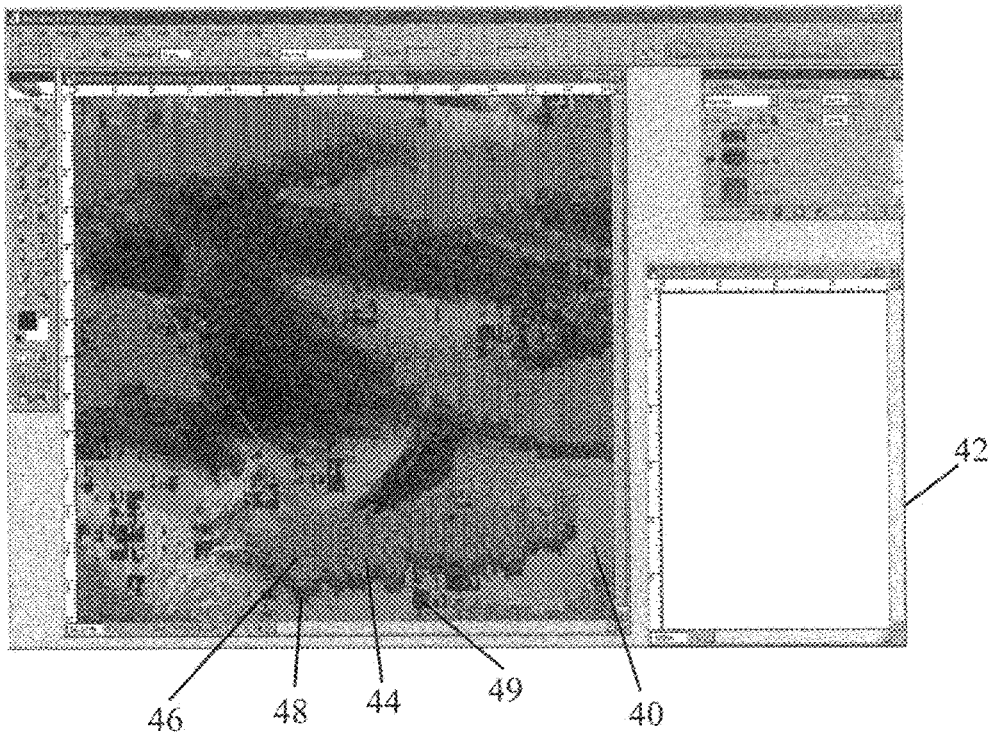

To create the final disruptive pattern 44 as used in the example of a camouflage pattern 50 shown in FIG. 9, the disruptive pattern 44 can include a top portion 46 and have a shadow portion 48 added to mirror or shadow the top portion 46 as shown in FIG. 7. The shadow portion 48 can be a darker shade or color as compared to the top portion 46. The shadow portion 48 can underlie the top portion 46 so as to create a shadow effect. The shadow effect of the top portion 46 and the shadow portion 48 add depth to the disruptive pattern 44 to further facilitate the visual confusion caused by the disruptive pattern 44.

Figure 8:
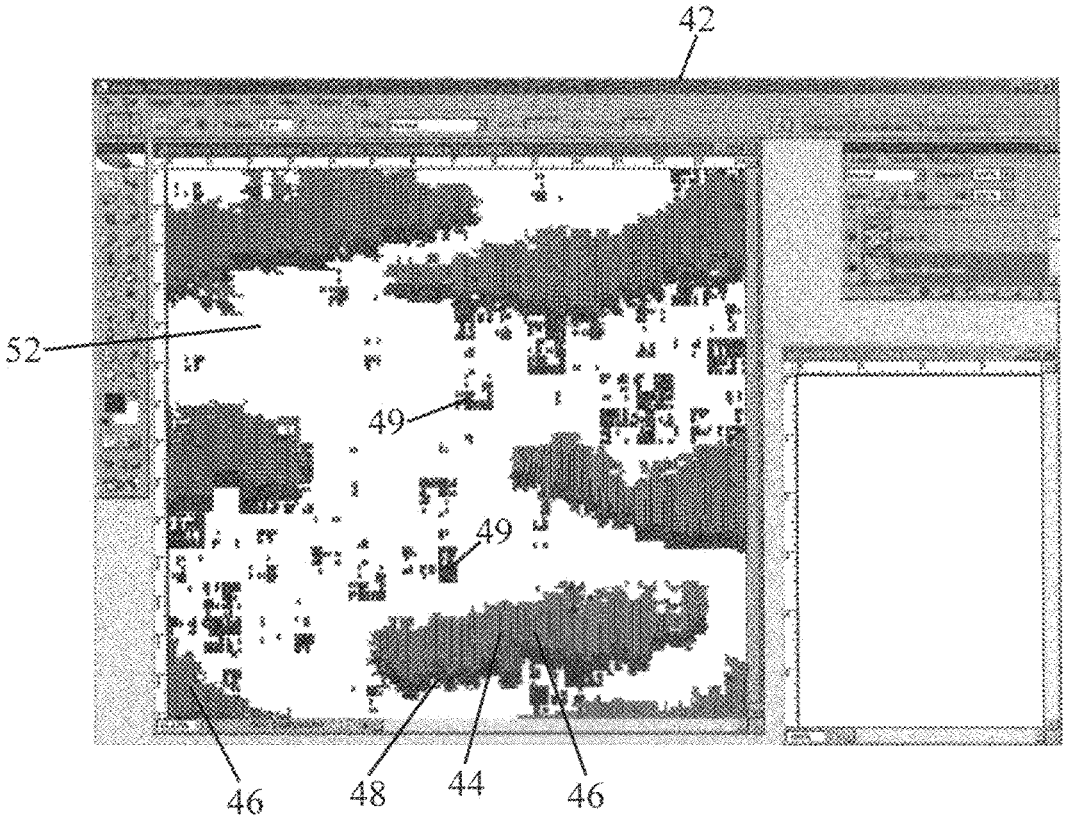

As shown in FIG. 8, additional micropatterns 49 can be added to increase the visual confusion. The additional micropatterns 49 are smaller patterns than the disruptive patterns 44 and can be a generally amorphous shape. The micropatterns 49 can include one or more additional colors not used in the disruptive pattern from the range of colors from the digital photographic image 40 and/or the operating environment in which the camouflage is intended to be used. The image-editing program can include computer assisted photo illustration software tools to add these micropatterns 49 to the suitably chosen digital photographic image 40. The micropattems 49 can be randomly dispersed over the area of the field of the digital photographic image 40 in the camouflage pattern 50 as shown in FIG. 9. As shown in FIG. 9, the micropatterns 49 when added to together with disruptive pattern 44 should not create patterns so dense as to overwhelm the digital photographic image 40 of the camouflage pattern 50.

As shown in FIGS. 5-8, after the selection of the digital photographic image 40, the creation of one or more colored disruptive patterns 44 and the micropatterns 49 can be accomplished in the image-editing program 42 on a gray scale background 52. Once the disruptive patterns 44 and the micropatterns 49 are created, the digital photographic image 40 can be opened again in the image-editing program 42 and the disruptive pattern 44 and micropatterns 49 can be configured on the digital photographic image 40 to create the camouflage pattern 50. In this manner, a digital photograph of the specific real operating environment can be manipulated to cause visual confusion due to disruptive patterning.

Once a suitable digital photographic image 40 of the operational environment has been acquired, and it is enhanced to improve its camouflage effect, digital copies of the created photographic camouflage pattern 50 can be saved at varying sizes for different sized applications on the computer or a memory device, such as a compact disk, a floppy disk, a portable zip drive, a memory drive, or the like. A "proof" sample can be printed out at this stage to check and see if color, clarity, and depth are achieved.

Figure 10:
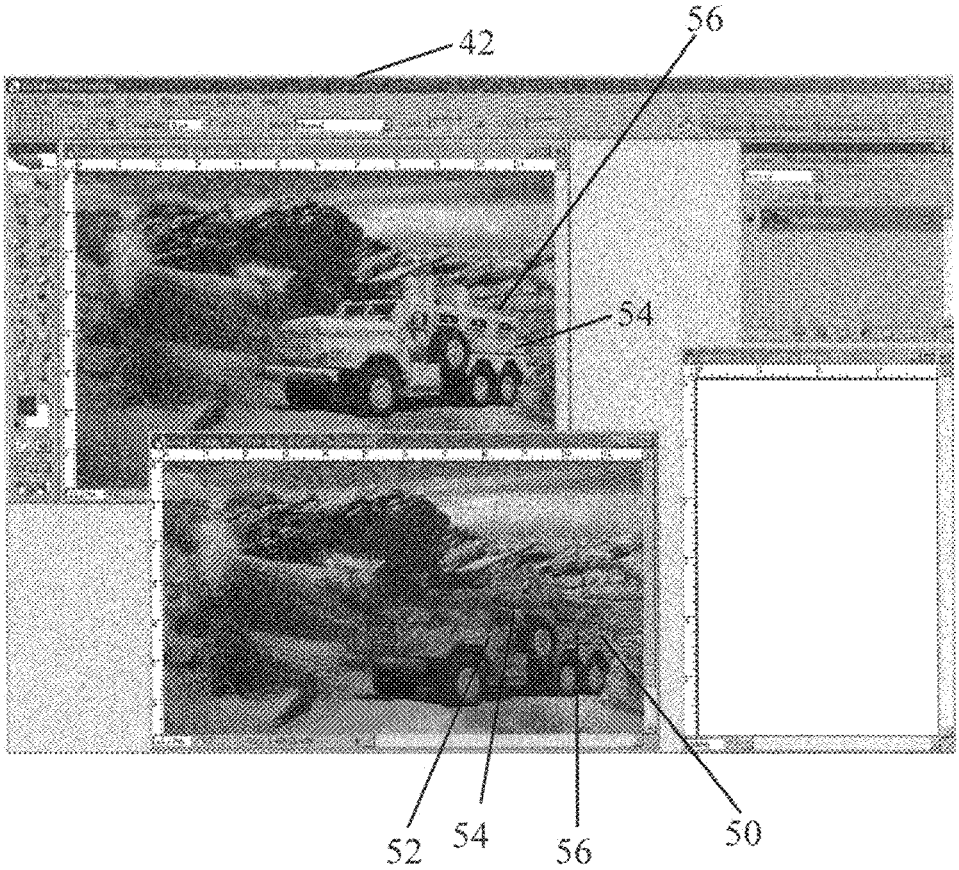

Next, a mock-up can now be created using the image-editing program 42 as shown in FIG. 10. Images of the particular physical item 54, such as a vehicle can be opened. The images of physical item 54 are digital, scaled-down versions of the vehicle for which the camouflage pattern 50 is designed. The images of physical item 54 can serve as an object template 56. This image can be a true to scale template. Therefore, when the camouflage is taken to a direct application, the measurements remain correct when printed in actual size. Lines can be added to the object template 56 to identify where the panels of camouflage would be on the vehicle.

The appropriate size of the previously saved photographic camouflage pattern 50 that best corresponds with the size of the physical item 54 to be camouflaged can be chosen and applied to the object template 56. Appropriate shading based on the shadows created by the physical item 54 can be used to create a general likeness of the physical item 54 as it would appear upon being camouflaged. This shading facilitates the determination of the viability of the created camouflage pattern. If the desired camouflage effect is achieved, further steps can be taken to create a camouflage material which will be described in greater detail below.

Alternatively, a process for creating a camouflage from a site-specific digital photographic image employing distortion disruptive patterns of images having different focal lengths can be used. In one embodiment, such a camouflage pattern can be created by placing smaller photographs or photograph sections layered over the original, or base, digital photographic image to achieve the desired disruptive effect that aids in the cause of visual confusion by inhibiting normal depth perception. This use of photo-over-photo technique achieves both a disruptive effect and makes the camouflage have a visual confusing effect at different focal distances.

In the embodiment shown in FIGS. 11-24, a process for creating a camouflage from site-specific digital photographic images using disruptive patterns of images having different focal lengths is described in more detail. As in this example, the camouflage pattern can be developed from a plurality of site-specific digital photographic images. First, two or more digital photographic images are procured or obtained that can be used in an intended operating environment. The digital photographic images can be site-specific photographic images.

Figure 11:
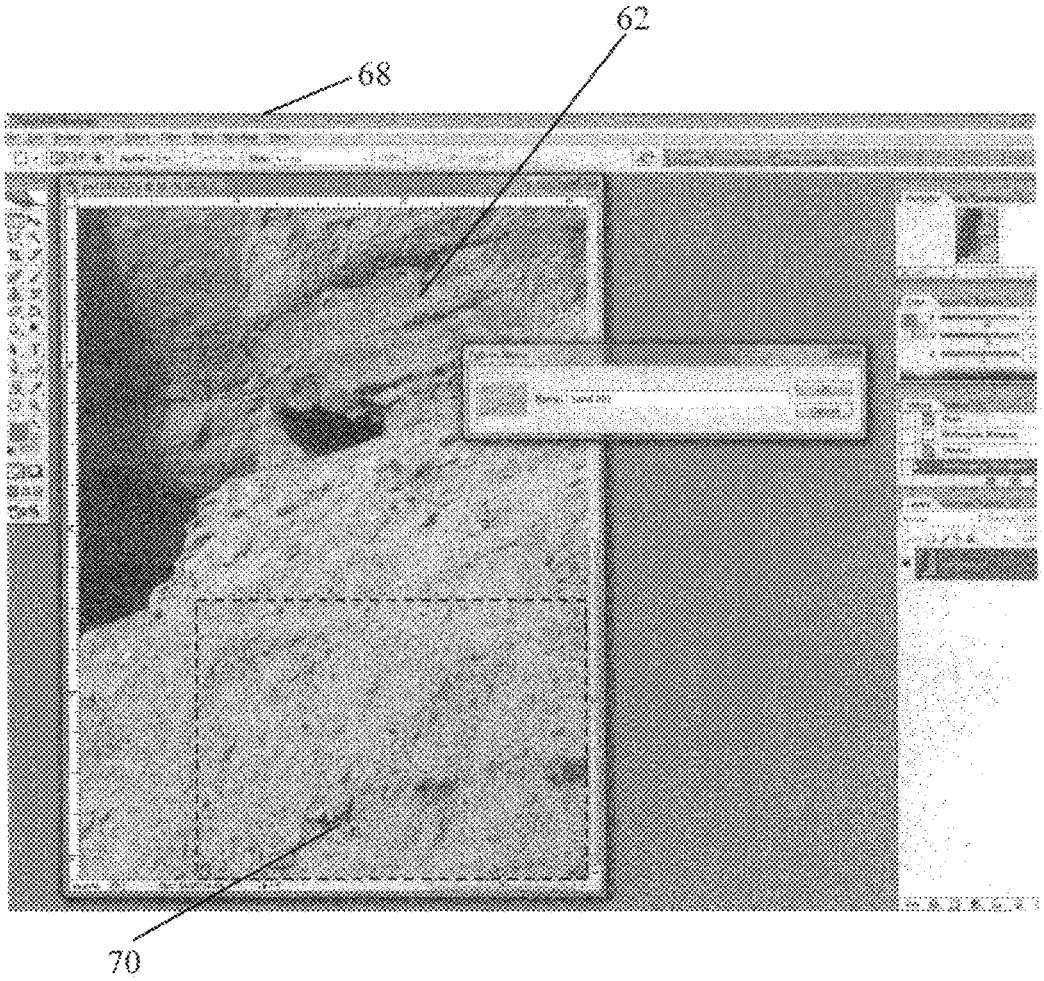
FIGS. 11-20 illustrate steps for creating other embodiments of a camouflage pattern or arrangement according to the present subject matter.
Figure 12:
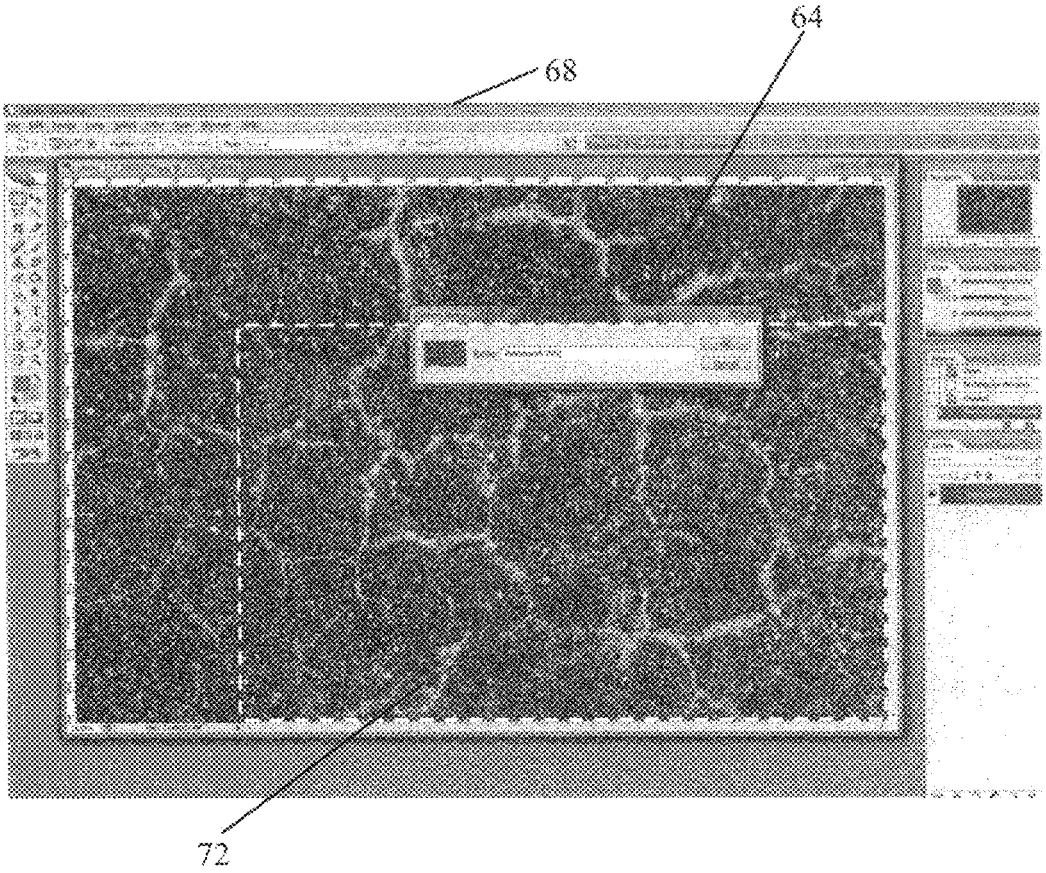
Figure 13:
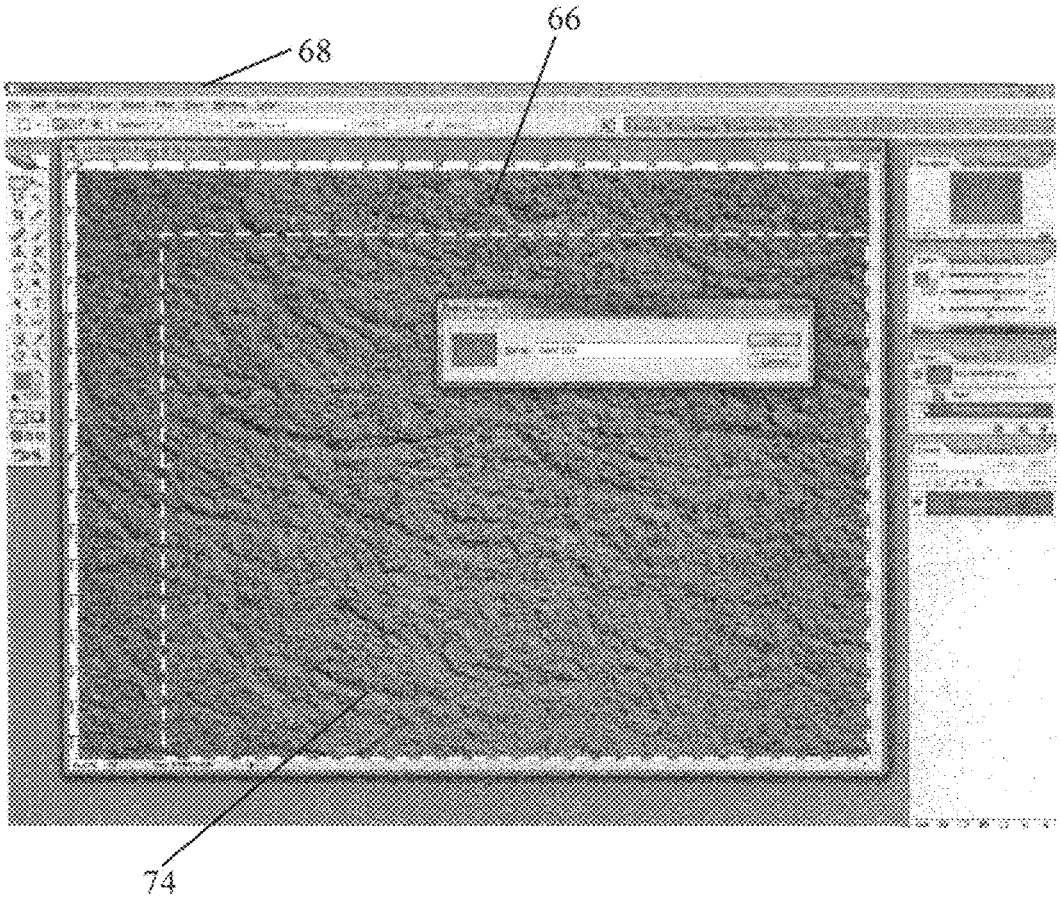

In the example shown in FIGS. 11-24, desert site-specific camouflage 60 (see FIG. 20) is being created from three site-specific photographic images 62, 64, 66 (see FIGS. 11-13, respectively). The digital photographic image 62 shown in FIG. 11 is a site-specific image of a portion of a sandstone landscape. The digital photographic image 64 shown in FIG. 12 is a site-specific image of a portion of weather worn desert pavement at a shorter focal length than that of digital photographic image 62. The digital photographic image 66 shown in FIG. 13 is a site-specific image of a different portion of a sandstone landscape than that of the digital photographic image 62. As can be seen, the digital photographic image 66 has a much shorter focal length than the digital photographic image 62. Thus, three different photographic images 62, 64, 66 having different focal lengths are provided. Further, the three different photographic images 62, 64, 66 are of site-specific elements common to the intended operating environment in which the developed camouflage will be used.

Each digital photographic image 62, 64, 66 can be opened on the computer in an image-editing program 68 as shown in FIGS. 11-13 so that the digital photographic images 62, 64, 66 can be manipulated to create a camouflage pattern for concealment or deception purposes. In FIG. 11, the digital photographic image 62 is opened in the image-editing program 68 on a computer and an image of an area 70 of the digital photographic image 62 can be isolated to be used in creating the camouflage. Similarly, the digital photographic image 64 is opened in the image-editing program 68 as shown in FIG. 12 and an image of an area 72 of the digital photographic image 64 can be isolated using the image-editing program 68. The digital photographic image 66 can also be opened in the image-editing program 68 as shown in FIG. 13 and an image of an area 74 of the digital photographic image 66 can be isolated to be used in creating the camouflage.

Again, each digital photographic image 62, 64, 66 is of a different area with a different focal length resulting in different magnification. If necessary, the isolated images of the respective areas 70, 72, 74 of the digital photographic images 62, 64, 66 can be further enhanced to differentiate the magnifications.

Figure 14:
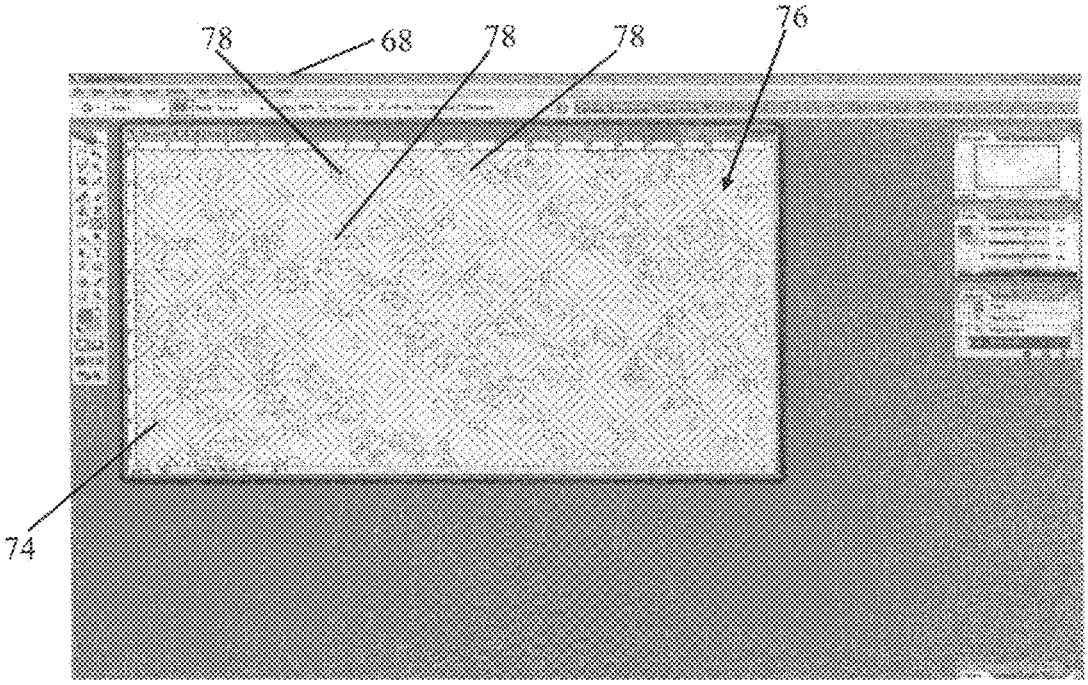
Figure 15:
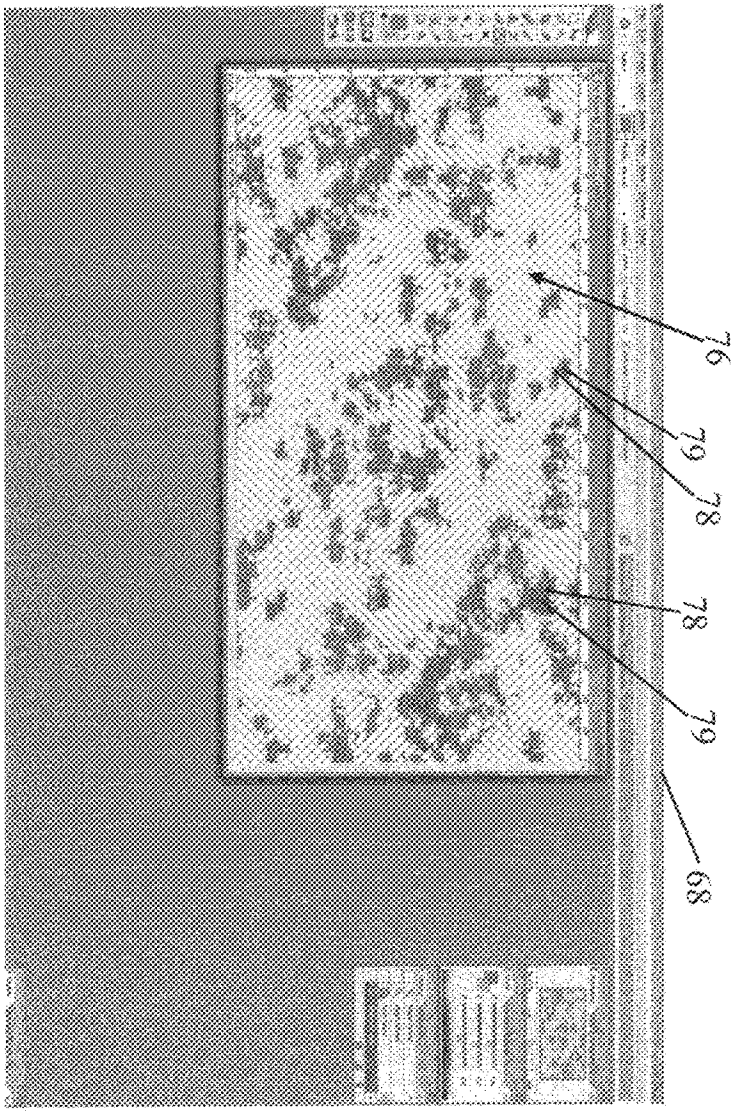

Before or after the images of the respective areas 70, 72, 74 of the digital photographic images 62, 64, 66 are isolated, a template of disruptive patterns can be created on a gray scale generally 76 (see FIG. 14) using the image-editing program 68 with different disruptive patterns identified to receive a different respective isolated image of the respective areas 70, 72, 74 of the digital photographic images 62, 64, 66. As shown in FIG. 14, a first disruptive pattern 78 can be generated or added to the gray scale 76. As described above, the disruptive pattern can be any shape. In the embodiment shown, the disruptive pattern 78 is a generally amorphous shape. This first disruptive pattern 78 can receive portions of an image from one of the areas 70, 72, 74 from one of the respective digital photographic images 62, 64, 66. As shown in FIG. 15, the image-editing program 68 can be used to drop in portions 79 of the image of the area 74 from the digital photographic image 66. In this manner, the image of the area 74 is applied to the first disruptive pattern.

Figure 16:
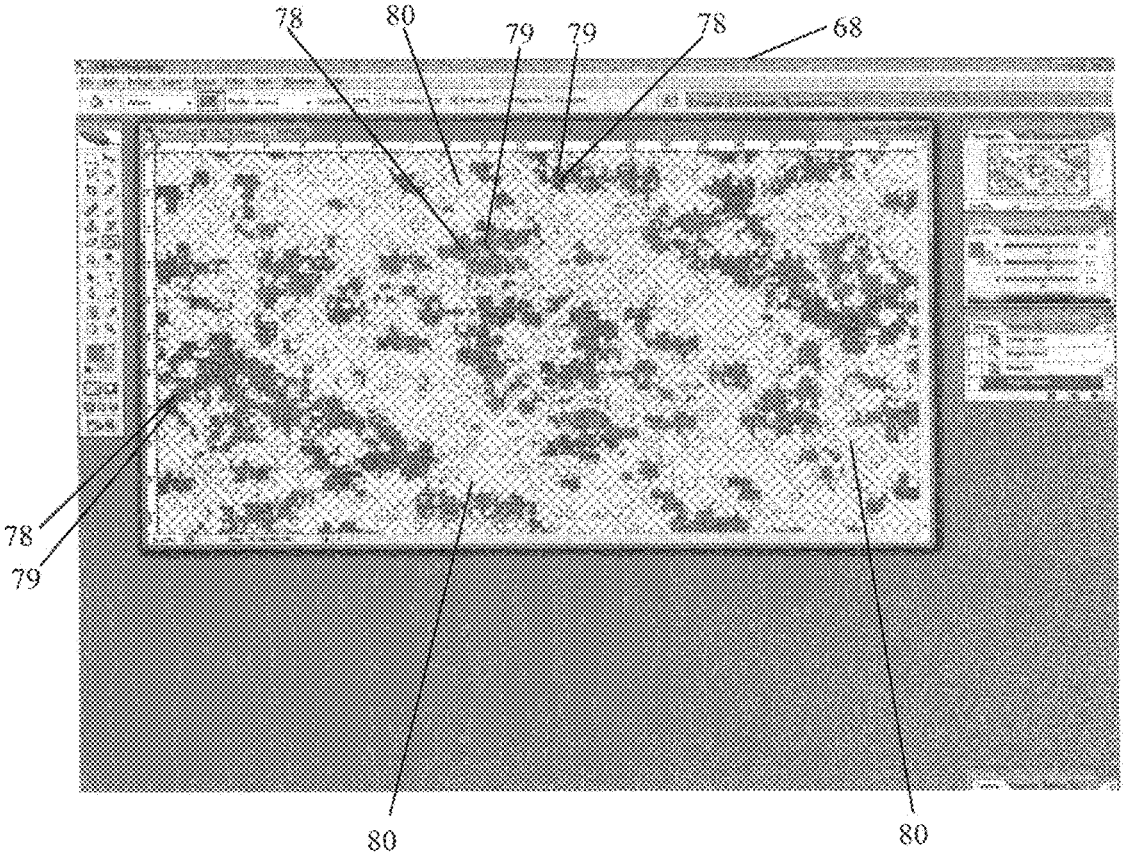
Figure 17:
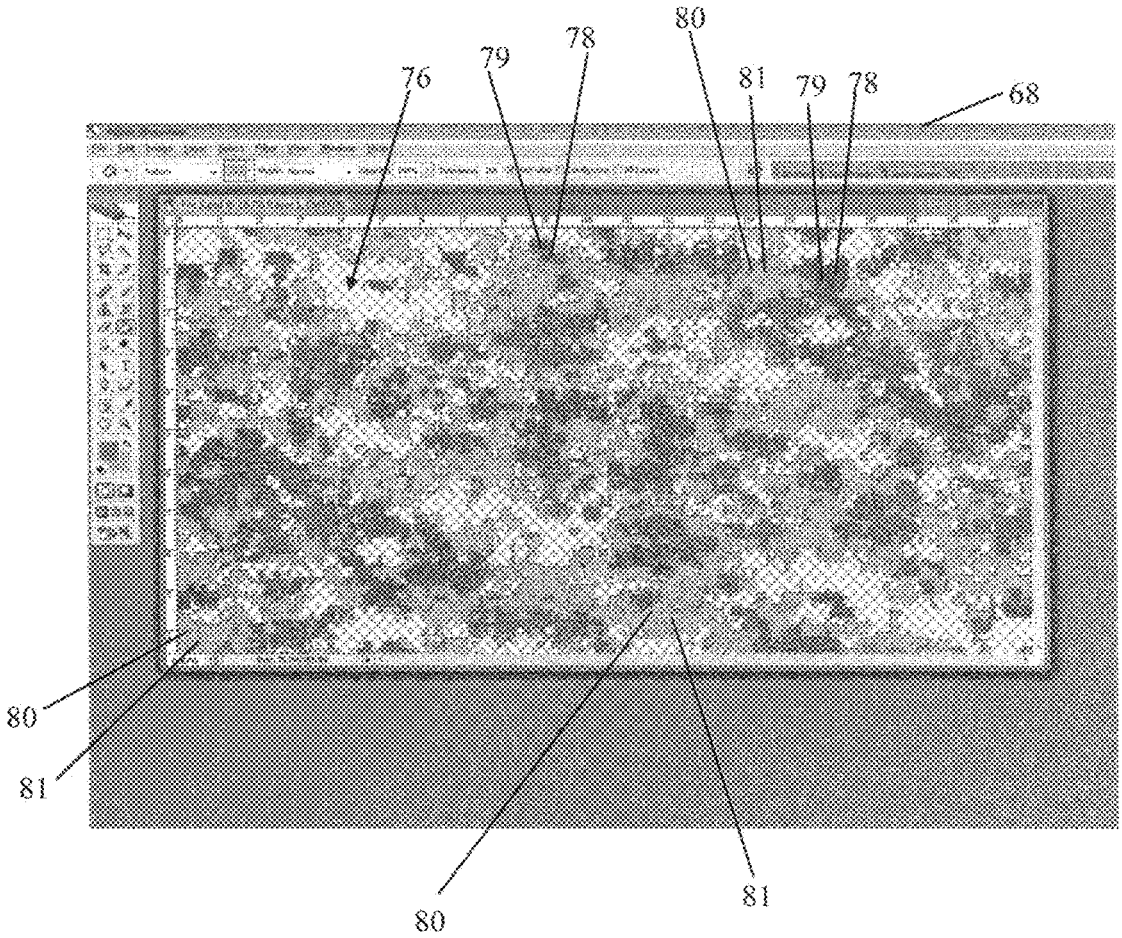

As shown in FIG. 16, a second disruptive pattern 80 can be generated or added to the gray scale 76. The disruptive pattern can be any shape. In the embodiment shown, the disruptive pattern 80 is a generally amorphous shape. This second disruptive pattern 80 resides in areas not occupied by the first disruptive pattern 78 containing the portions 79 of the image of the area 74. The second disruptive pattern 80 can receive portions of one of the remaining images of the areas 70, 72 from one of the respective digital photographic images 62, 64. As shown in FIG. 17, the image-editing program 68 can be used to drop in portions 81 of the image of the area 70 from the digital photographic images 62. In this manner, the image of the area 70 is applied to the second disruptive pattern.

Figure 18:
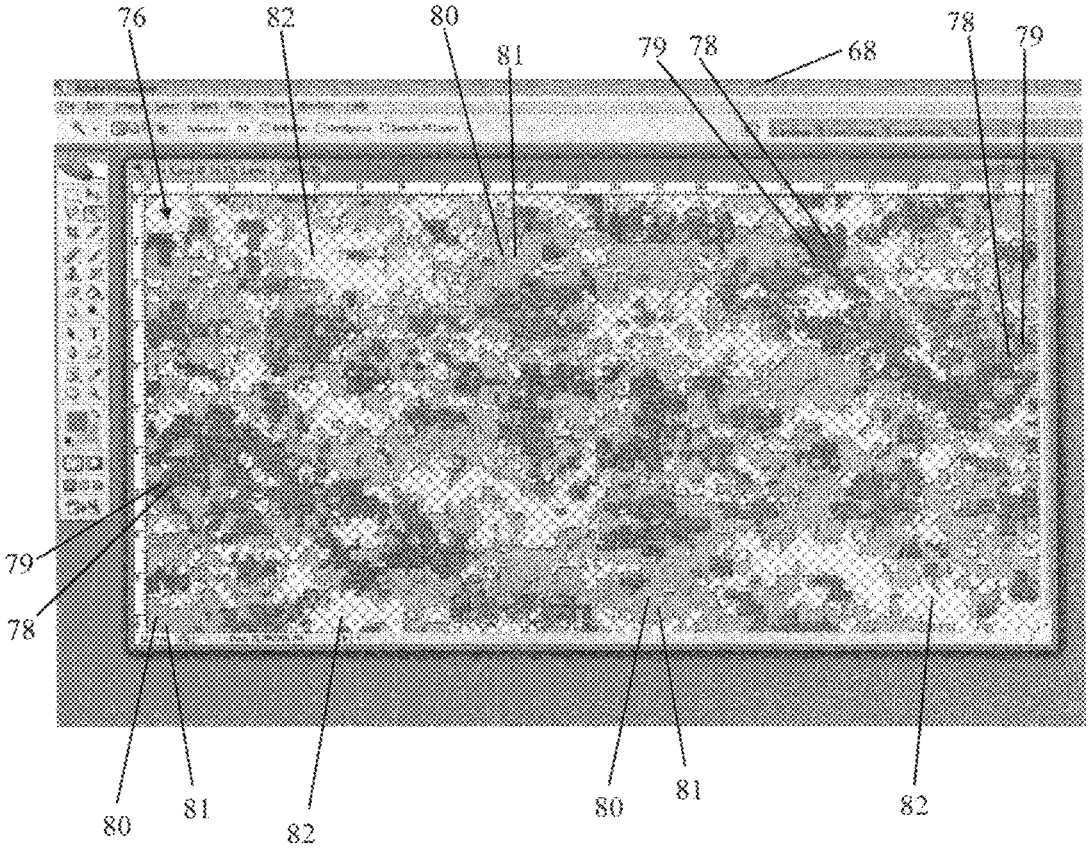

As shown in FIG. 18, a third disruptive pattern 82 can be generated or added to the gray scale 76. The disruptive pattern can be any shape. In the embodiment shown, the disruptive pattern 82, like the other disruptive patterns 78, 80, is a generally amorphous shape. This third disruptive pattern 82 resides in areas not occupied by the first and second disruptive patterns 78, 80 containing the portions 79, 80 of the image of the respective areas 74, 70. Since only three disruptive patterns are used in this example, the third disruptive pattern 82 resides in any area not occupied by the other two disruptive patterns 78, 80.

Figure 19:
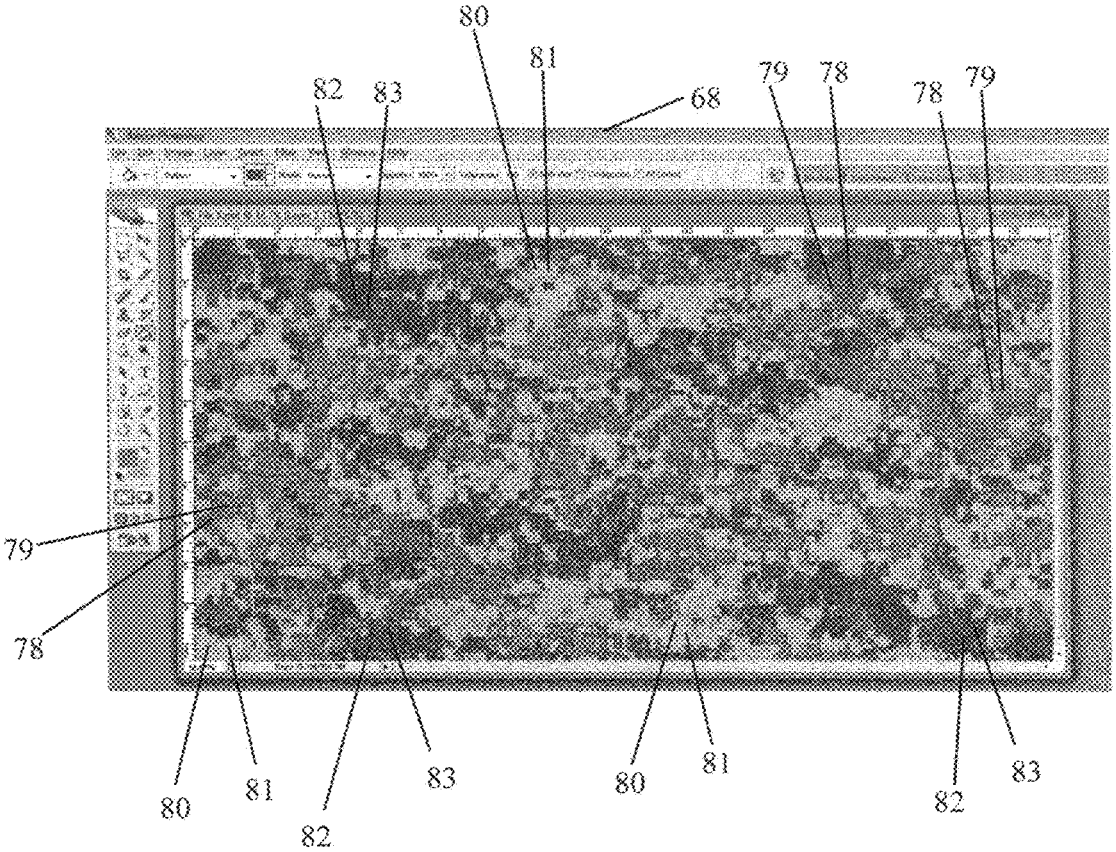

The third disruptive pattern 82 can receive portions of the remaining image of the area 72 from one of the respective digital photographic images 64 not used in the other disruptive patterns 78, 80. As shown in FIG. 19, the image-editing program 68 can be used to drop in portions 83 of the image of the area 72 from the digital photographic images 64. In this manner, the image of the area 72 is applied to the third disruptive pattern.

Figure 20:
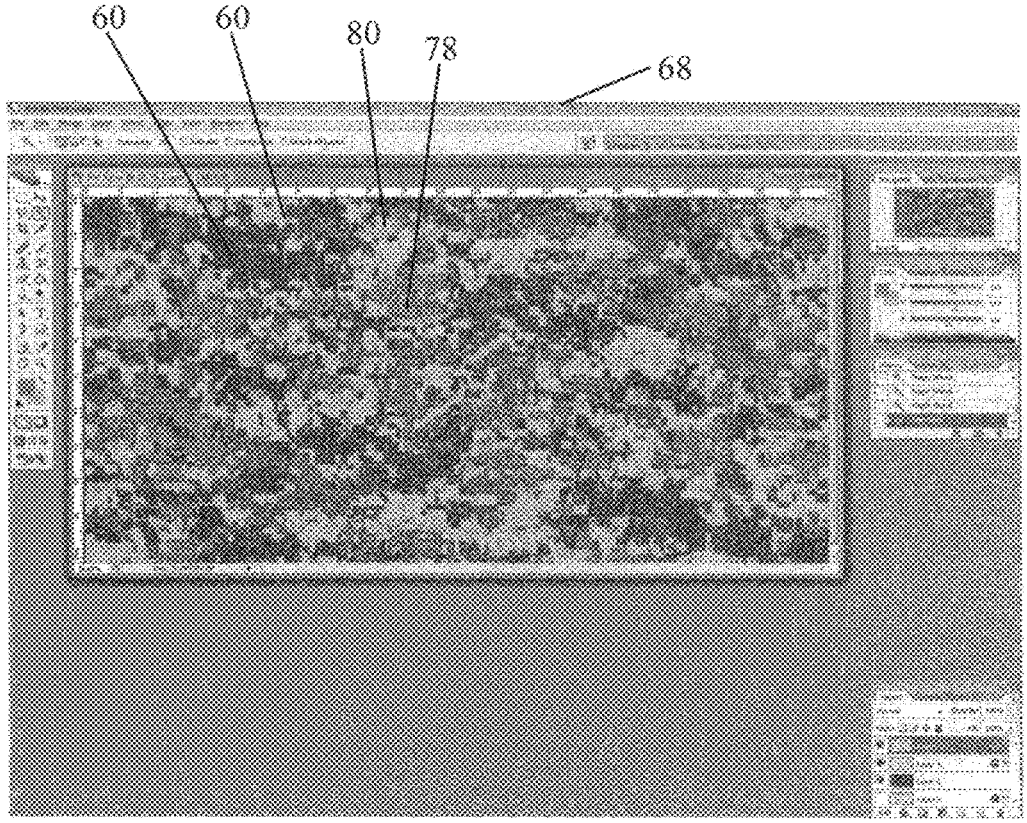
Figure 21:
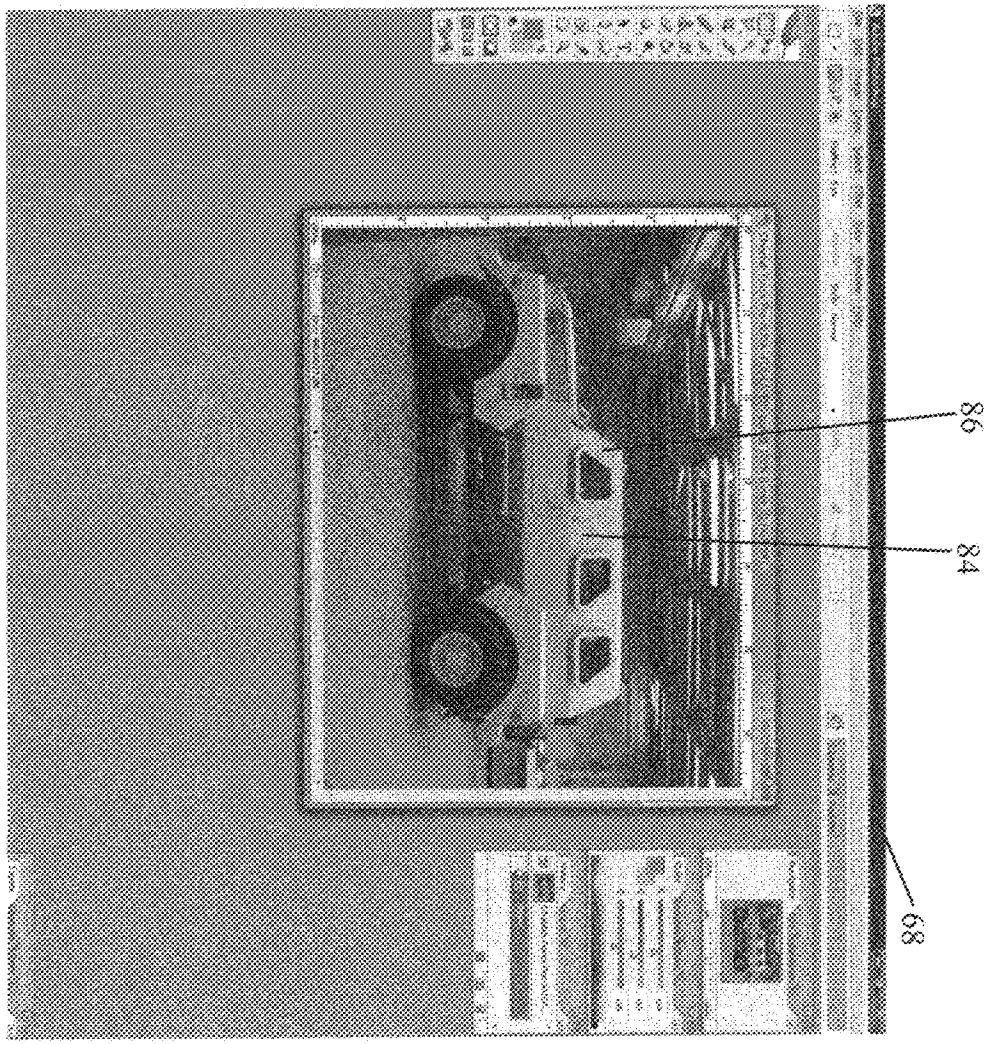
FIGS. 21-24 illustrate steps for an embodiment of a mock-up process for embodiments of a camouflage pattern or arrangement according to the present subject matter.

Once the last disruptive pattern has an image applied to it and any clean-up using the image-editing program 68 is conducted, a camouflage pattern 60 is created as shown in FIG. 20. The camouflage pattern 60 has three disruptive patterns 78, 80, 82 having different images of areas 70, 72, 74 from different site-specific photographic images 62, 64, 66 that have different focal lengths to create visual confusion for concealment and deception. One or more of the different focal lengths of such images can be improper focal lengths (not shown) that cause those images to appear out of focus. Generally, it should be understood that such camouflage patterns can include two or more disruptive patterns. For example, four or five patterns can be used in make such camouflage.

Digital copies of the created photographic camouflage pattern 60 can be saved at varying sizes for different size applications on the computer or a memory device, such as a compact disk, a floppy disk, a portable zip drive, a memory drive, or the like. A "proof" sample can be printed out at this stage to check and see if color, clarity, and depth are achieved.

Figure 22:
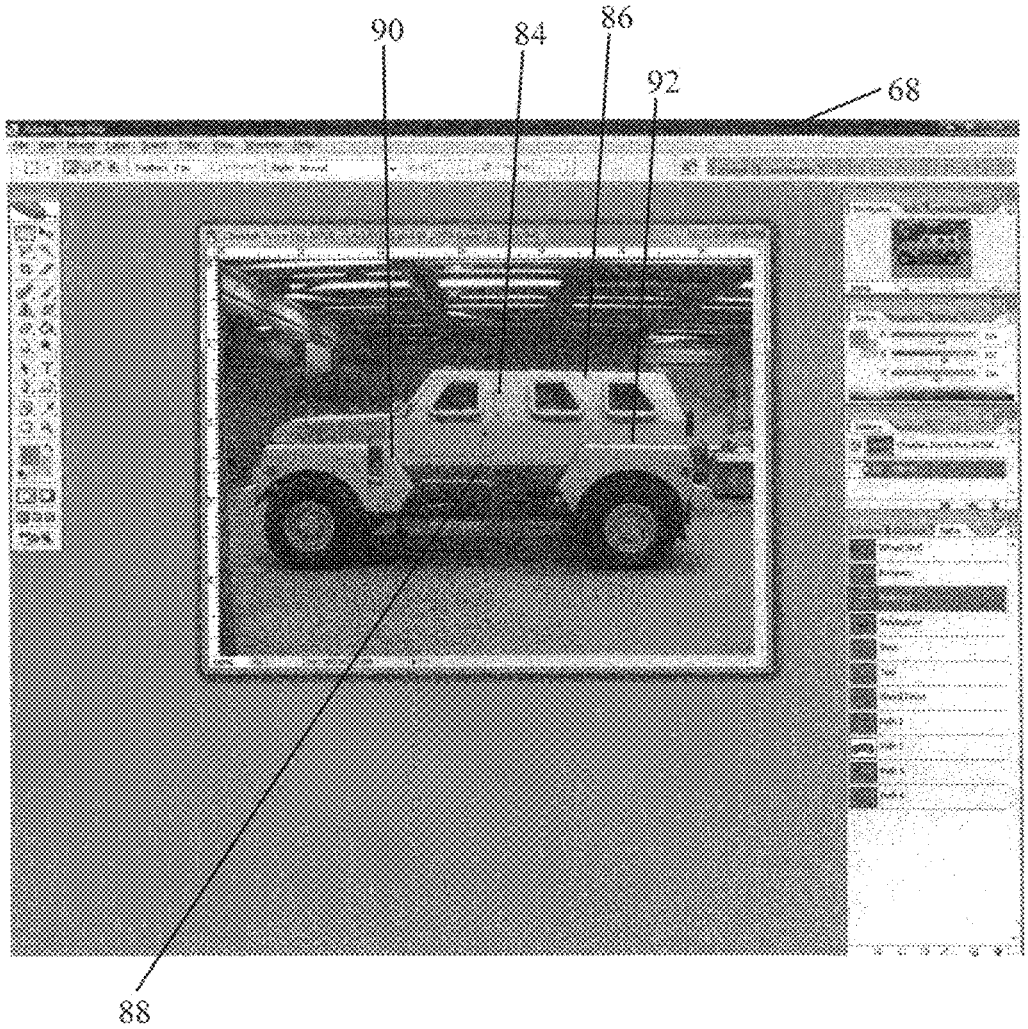

Next, a mock-up can now be performed using the image-editing program 68 as shown in FIG. 21-24. Images of the particular physical item 84, such as a vehicle, can be opened in the image-editing program 68 on the computer. The images of physical item 84 are a digital, scaled down versions of the vehicle for which the camouflage pattern 60 can be designed. The images of physical item 84 can serve as an object template 86. This image can be a true to scale template. Therefore, when the camouflage 60 is taken to a direct application, the measurements remain correct when printed in actual size. As shown in FIG. 22, the object template 86 of the physical item 84 is "pathed" by adding lines such as lines 88, 90, 92 to the object template 86 to identify where the panels of camouflage 60 would be affixed onto the vehicle.

Figure 23:
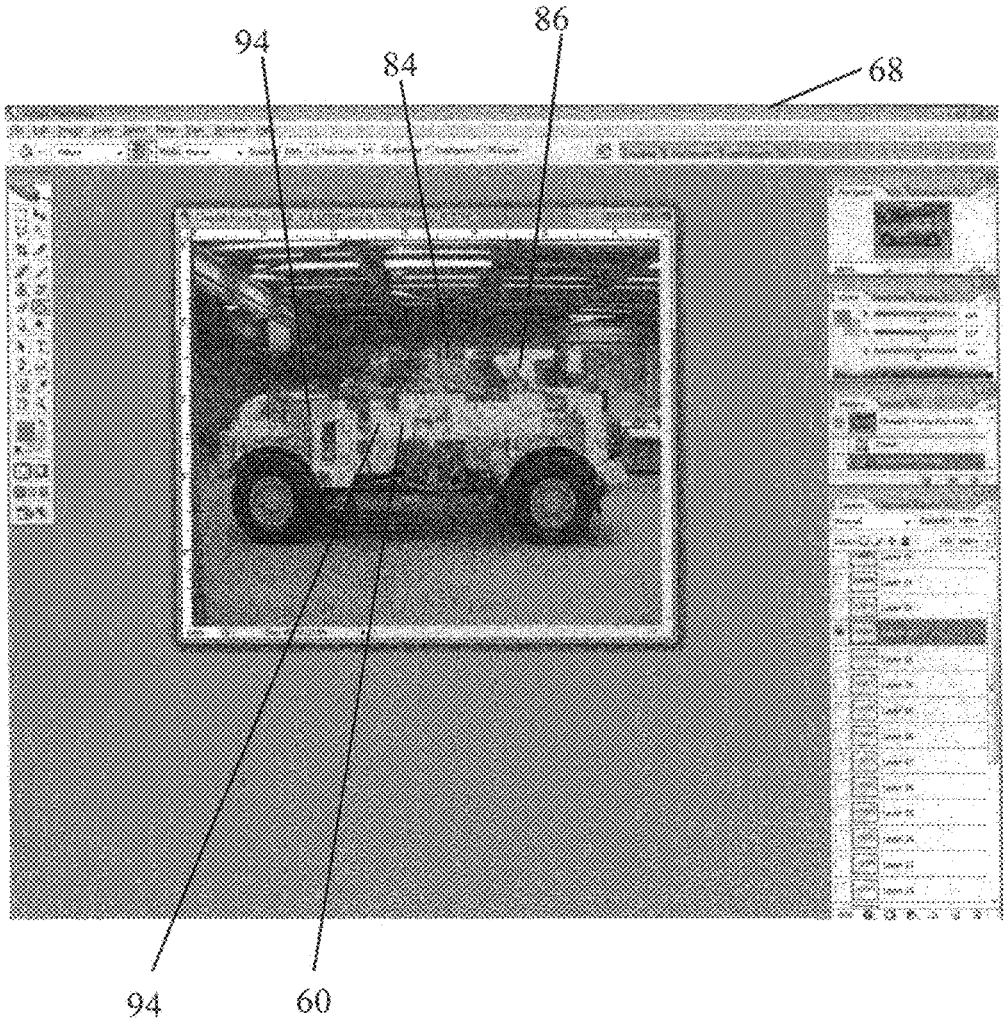

As shown in FIG. 23, the appropriate size of the previously saved photographic camouflage pattern 60 that best corresponds with the size of the template 86 of the physical item 84 to be camouflaged can be chosen. Using the image-editing program, the image or images of the camouflage 60 can then be divided into sections to create appropriately sized panels 94. The panels 94 can be applied to the object template 86 using the image-editing program 68.

Figure 24:
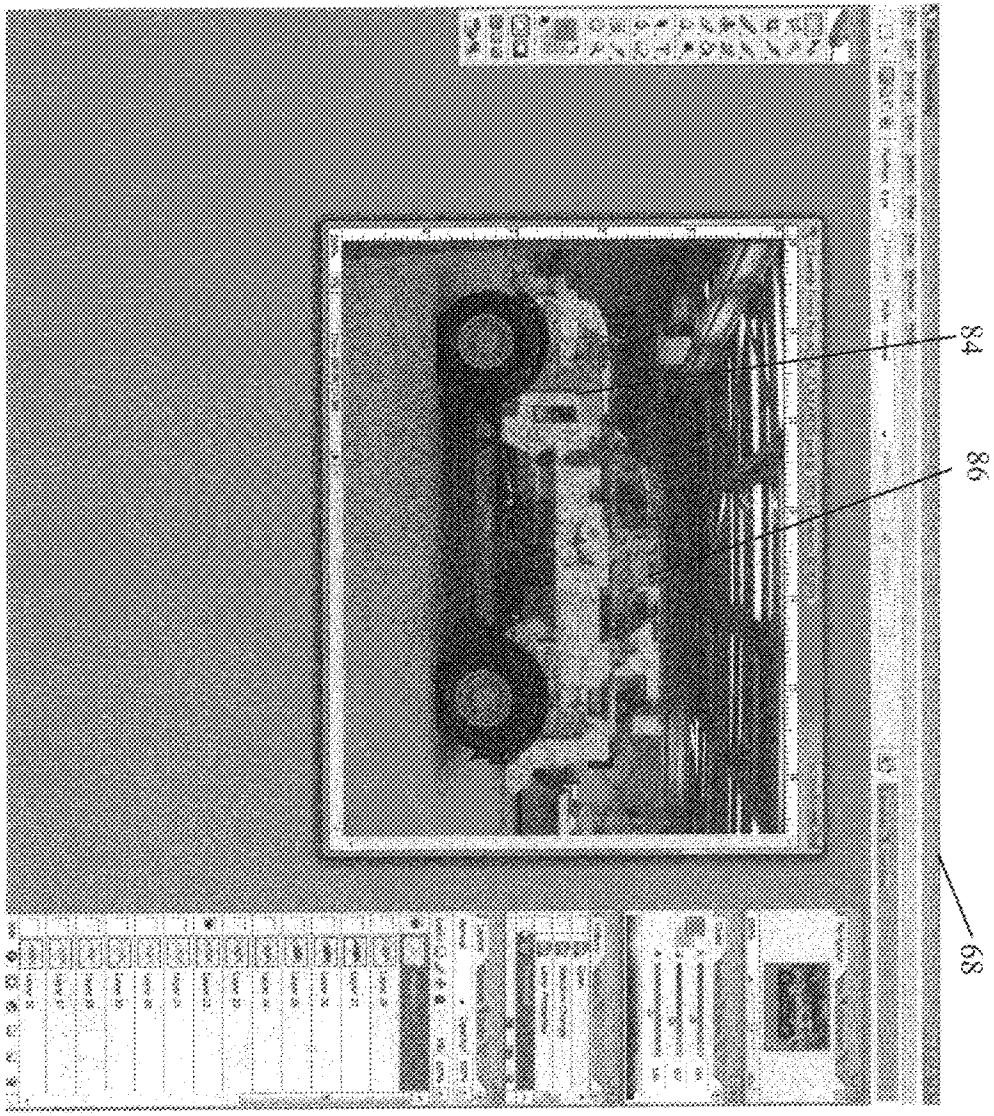

As shown in FIG. 24, appropriate shading based on the shadows created by the physical item 84 can be added to the template 86 using the image-editing program 68 to create a general likeness of the physical item 84 as it would appear upon being camouflaged with the created pattern to determine its viability. Again, this shading adds realism to test the effectiveness of the finished design without have to create a finished product. If the desired camouflage effect is achieved, further steps can be taken in creating a camouflage material which will be described in greater detail below.

Figure 25:
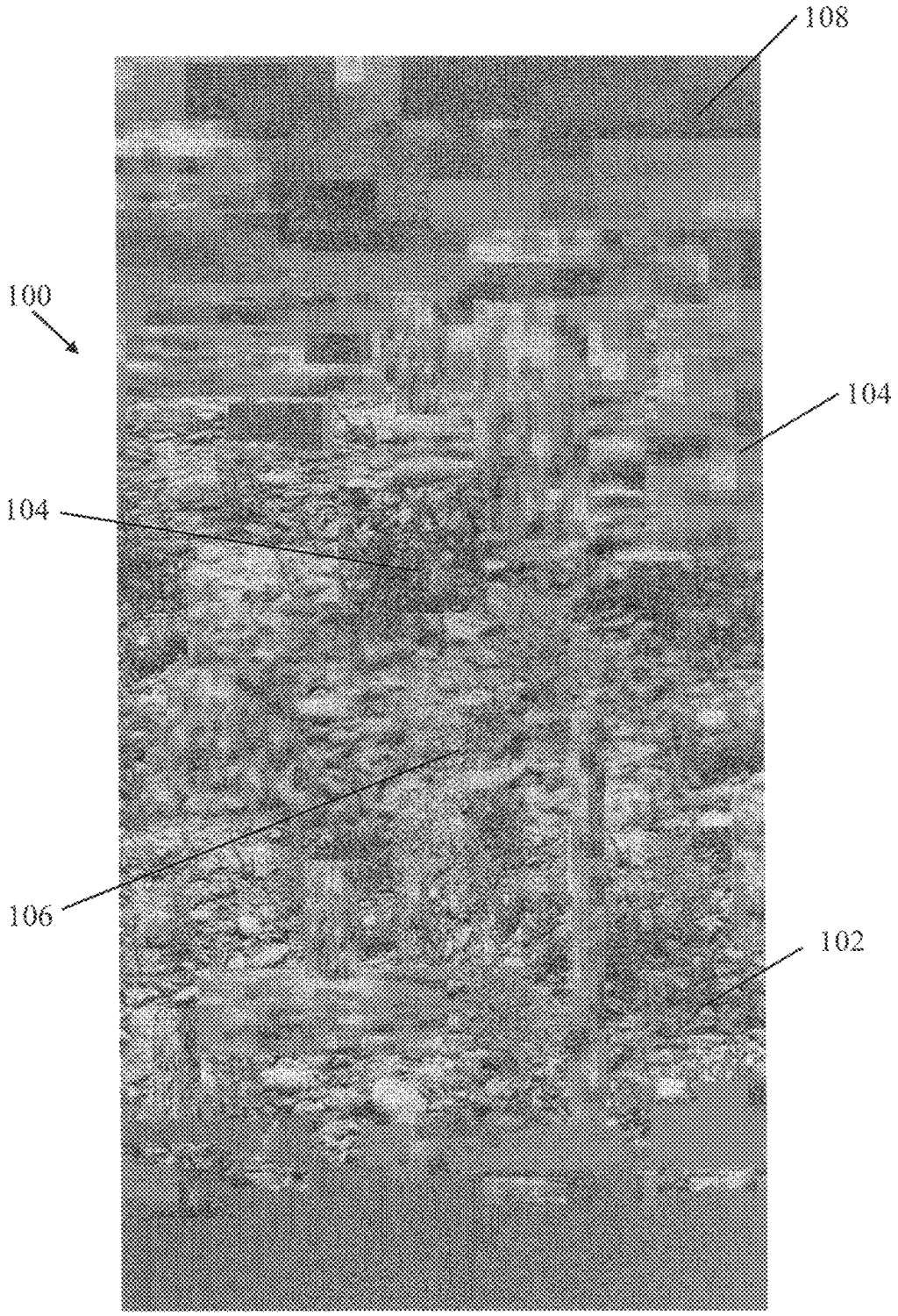
FIG. 25 illustrates a further embodiment of a camouflage pattern or arrangement according to the present subject matter.

In an embodiment shown in FIG. 25, a camouflage pattern 100 can be created by taking a base digital photographic image 102 and creating disruptive patterns 104, 106, 108 of distortions through the use of magnifications or demagnifications of portions of the digital photographic image 102. Such disruptive patterns 104, 106, 108 of distortions can make use of portion of image 102 having improper focal lengths to create disruptive patterns that are out of focus. The disruptive patterns 104, 106, 108 of distortions can be generated and layered over the base digital photographic image 102 using an image-editing program on a computer to achieve the desired disruptive effect in the camouflage 100 that aids in creating visual confusion by inhibiting normal depth perception.

As shown in FIG. 25, image 102 can have can have disruptive patterns 104, 106, 108 of different portions of the image 102 that have different focal lengths. For example, disruptive pattern 106 can have a longer focal length than the base image 102 with disruptive pattern 106 still being in focus. Disruptive pattern 104 can have an improper focal length that creates a blurred distortion that is somewhat out of focus. Further, disruptive pattern 108 can also have an improper focal length that creates a blurred distortion that is even more out of focus than the disruptive pattern 104. This use of photo-over-photo technique also achieves both a disruptive effect and makes the camouflage 100 have a visually confusing effect at different focal distances.

As described above, such disruptive patterns with blurred distortions can create further visual confusion for an observer and/or for an electronic and/or optical device. For example, an optical or electronic device that detects a physical item that contains images having multiple focal lengths and/or image portions having improper focal lengths that creates an out of focus portion will have difficulty focusing on the physical item and/or determining a correct distance between the device and the physical item. Such visual confusion aids in camouflaging and protecting the physical item.

Some or all of these techniques and enhancements used in the camouflage embodiments described above can be used together or separately according to the desired effect or effects. The description provided below can be used with any of the camouflage embodiments described above, unless stated otherwise.

Once the desired camouflage effect is confirmed as described above, a second proof can be printed at this stage to check and see if the appropriate color, clarity, and depth are still being achieved and the camouflage still is an ideal match for the operating environment.

Next, using the image-editing program, the image of the camouflage can be divided into the sections called panels hereinabove. After printing, these panels will fit together overlapping one another when placed on the physical item. No registry lines are necessary. The overlapping of the panels improves seal, adhesion, and installation procedures. The sizes of the panels can depend on the size of the physical item to be camouflaged and are only constrained by the cost effectiveness of the selected size, manageability of the installation process, and the printer capabilities. For example, the panels can range from a few square inches to lengths and widths of 100 inches or more.

Figure 26:
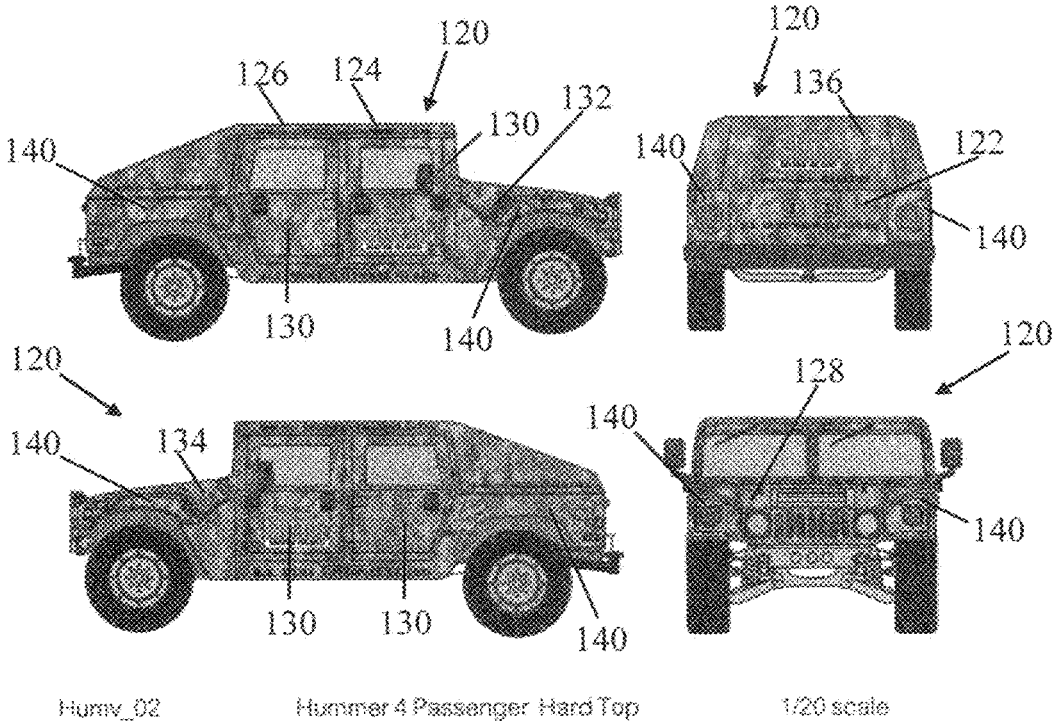
FIG. 26 illustrates an embodiment of a physical item having an embodiment of a camouflage pattern or arrangement attached thereto according to the present subject matter.

The panel process and application is explained using a specific example of a typical U.S. Military 1025 Humvee 120 shown in FIG. 26. However, the same general process can be used with other physical items. The design is divided into the following corresponding panels which in FIG. 26 have been printed to a substrate such as a polyvinyl chloride (PVC) film and already applied to the Humvee 120: a tailgate panel 122, a first roof panel 124 (partially shown), a second roof panel 126 (partially shown), a boot panel 128, door panels 130, a center hood panel (not shown), left and right hood panels 132, 134, (partially shown), a back panel 136, and fender/frame panels 140.

If the three items of color, clarity, and depth are achieved, then the panel sections are saved and sent to the printer to begin the "rip" process of transferring the panel images to the printer and the printer's software. Before the rip process is to begin, another proof can be printed to make sure that nothing has moved or been dropped from the file. Once this proof is checked, a test print process of printing an actual panel or a portion of an actual panel on a substrate can be done to make sure the colors match between the camouflage pattern image on the screen of the computer and the camouflage printed on the substrate.

If there is a match, the production operator then begins to print the necessary panels for the Humvee 120. In the case of the Humvee 120, there are 15 panels that are printed in our process. Each panel runs different in size. The sizes provided below are provided as only examples and the number and size of the panels may vary based on the criteria outlined above. In particular, the sizes of the panels can depend on the size of the physical item to be camouflaged and are only constrained by the cost effectiveness of the selected size, manageability of the installation process, and the printer capabilities. The selected sizes can assist with the installation process. The selected sizes can help with manageability and control of the product for the installation crews during the installation process. The selected sizes can promote versatility as some of the installations are done outdoors and some are done indoors. Wind and the elements are a factor in the installation process.

For the example Humvee 120, 15 panels can be printed in the following sizes:

1. 1-21"×87" tailgate panel;
2. 1-52"×74" first roof panel;
3. 1-52"×74" second roof panel;
4. 1-60"×53" boot panel;
5. 4-95"×53" door panels;
6. 1-54"×70" center hood panel;
7. 1-36"×70" left hood panel;
8. 1-36"×70" right hood panel;
9. 2-53×80 back panel;
10. 1-53"×80" first fender/frame panel; and
11. 1-53"×80" second fender/frame panel.

The camouflage pattern can be printed on a substrate. The substrate can be a thermoplastic film, a mesh, a nonwoven, knitted or woven fabric, netting, or the like. The substrate used can depend on the end use of the camouflage material and the operating environment.

An example of a thermoplastic film that can be used is a polyvinyl chloride ("PUC") film. For such a film, the conditions in the printing area are preferably controlled. For example, the room temperature and relative humidity can be between about 60° F. to about 90° F. and the relative humidity can be between about 50% to about 90% RH. For instance, the temperature and relative humidity can be about 73° F. (23° C.) and 50% RH when using as a substrate a 2.7 mil gloss white, polymeric stabilized, soft calendared PVC film designed for receiving digital ink jet printers. The ink used can be printing inks such as digital printing inks. Different inks can be used to ascertain different properties in the final product. The substrate used can be coated on one side with a permanent, opaque, acrylic, pressure sensitive adhesive with air egress technology and supplied with a 80# poly coated liner that is used as a release liner to protect the adhesive until time for application. Below is a list of physical properties of an example acrylic adhesive that can be applied to a substrate such as the PVC film described above.

TABLE 1

Properties of an Example Pressure Adhesive

| Physical Properties | Typical Values | Test Method (Federal Test Methods used) |
|---|---|---|
| Peel Adhesion, lb./in. (N/25 mm) 180 degrees on glass-24 hr | about 3.2-about 4.6 (about 14-20) | FTM-1 |
| Quick Tack on Glass lb./in. (N/25 mm) | about 3.4-about 4.8 (about 15-about 21) | FTM-9 |
| Dimensional Stability, (%) 10" by 10" sample bonded to Aluminum | Maximum of about 0.5 | FTM-14 |
| Normal Application Temperature and Temperature Ranges for Minimum Application | Above about 50° F. (about +10° C.) About −40° F. to about 194° F. (about −40° C. to about 90° C.) | |

Once the material is printed, it is laid on a drying table and left to "gas" or "dry" for a period of about 72 hours to ensure that the ink is dry. Once the material has gone through the 72 hour period and depending on the end use of the camouflage material, then it can be laminated in a lamination process to provide an overcoating. For example, for a substrate of a PVC film to be used to cover a vehicle, the PVC film can be laminated. Laminating a substrate like PVC film can add strength and protection to the printed image. For example, a laminate when bonded with the PVC film can provide protection to a vehicle on which it is applied (and any individuals inside) against chemical and biological agents and it can help protect the vehicle from corrosive agents as well. It can also be used to add gloss or a reflection control layer.

The material used in such a lamination process can be a highly conformable cast film, such as a PVC film, that can range in thickness from about 0.5 mm to about 10 mm. For example, highly conformable cast film having thickness of about 1.5 mm can be used. A cast vinyl laminate can have a built-in ultraviolet protection, be optically clear, and have a low gloss or no-gloss (flat) finish or matte. The laminate can include a permanent adhesive, such as an acrylic adhesive.

The printed substrate and the laminate can be run through a lamination process where the adhesive side of the laminate faces the printed side of the substrate. The laminate and substrate can then pass through pressurized heated or unheated rollers to secure the laminate to the substrate. The laminate can be usable in temperatures from about 50° F. to about 225° F. Thus, the laminate can be applied to the substrate in hot and cold applications. In the PVC film example, the substrate can be left to cool after the material is laminated at about 120° F.

In another example, a 1.5-mil clear matte or a 1.5-mil clear gloss, which are highly conformable cast PVC films, can be chosen as the laminate. The over-laminate film is coated on one side with a clear permanent, acrylic pressure sensitive adhesive and supplied with a 1.2 mil polyester release liner. Upon application, the release liner can be removed. The printed substrate and the laminate can be aligned so that the adhesive side of the laminate faces the printed side of the substrate. The laminate and substrate can then pass through pressurized rollers to secure the laminate to the substrate. UV protection can incorporated into the over-laminating film to help extend the life of the graphic by resisting color fade caused by ultraviolet light.

Suitable substrates with the printed camouflage patterns described above that have a protective overcoating laminated thereto can provide excellent camouflage capability and permit quick changeability for the user to change the camouflage if the operating environment of the physical item to be cover is to change. An installation process for securing the camouflaged substrate to a physical item is described in more detail below.

For an embodiment of a substrate with the camouflage pattern thereon that is to be attached to a physical item, an installation process can be used to facilitate proper attachment to the wherein the substrate is the PVC film example given above, installers now prepare the vehicle for the installation process. The installation process can be done in various ways. An example process is provided below. The example installation process contains six general steps. The steps of the example installation process are provided below.

Step 1. Check the Material

1. Look at the template; it should be confirmed that the overlapping panels to be installed are the correct panels for the physical item selected for installation.
2. Confirm that all overlapping panels are available.
3. Do an initial "tape up" to ensure proper fit & alignment placing emphasis on not losing any text or design features.

Step 2. Remove Obstacles

1. Determine if accessories from the physical item to be camouflaged need to be removed to facilitate attachment of the overlapping panels to the physical item. Examples of accessories for a vehicle can include the following:
2. Mirrors;
3. Antennas;
4. Door handles;
5. Rubber window tracks;
6. Lamp Assemblies;
7. Emblems (ask customer, some may not want off); and
8. Any old graphics (pin stripping & vinyl decals, etc).

Step 3. Clean Vehicle Thoroughly

1. Use a good wax & grease remover (wet rag & dry rag) and follow up with alcohol to thoroughly clean the physical item.
2. Emphasis should be placed on areas of the physical item that tend to be exposed to or collect dirt. For example, on a vehicle, all doors, hood, trunk edges, fender wells, moldings door handles, or the like should be emphasized.

Step 4. Install Wrap

1. Do an exact tape up.
2. Mark line up points on physical items.
3. It is recommended that the installation start at the rear of the physical item and work to the front. However, the installation can start at the front of the physical item and work to the rear. The panels can overlap. The amount of overlap depends on factors that can include, for example, intended use, environment of use, the type and size of the physical item, and the type of substrate, laminate or ink used. The overlap can range from about 0.75 inches to about 3 feet depending on the application and the factors listed above.
4. During and after an installation of a panel, the panel may need to be cut. When cutting, be sure not to cut on a body or any plastic parts of the physical item as it can leave a permanent mark.
5. Heat in all edges & relief cuts to smooth the edges.
6. Look over the installation carefully.
7. Check for lifting in any convex or concave curves and reheat, if necessary.

Step 5. Install Window Perforation (If Needed)

1. Some physical items may include glass that can be camouflaged with a perforated material commonly used on glass in the industry having the camouflage pattern printed thereon. If glass is to be covered, the glass should be cleaned with glass cleaner. Preferably, no Ammonia is used. This cleaning can be followed with a wipe down of the glass of Isopropyl Alcohol.
2. Cut the Perforated material 1/16 of an inch from the edge to ensure it does not get caught in the window rubbers.
3. Run rivet brush around edges to ensure adhesion.
4. When cutting, make straight cuts.

Step 6. Reinstall Removed Items (If Necessary)

1. Be careful not to damage the installed panels.
2. Analyze the installed panels looking for any areas that may fail.

Examples of places to inspect on a vehicle include: Fender wells, all edges, door handles, or the like.

Figure 27:
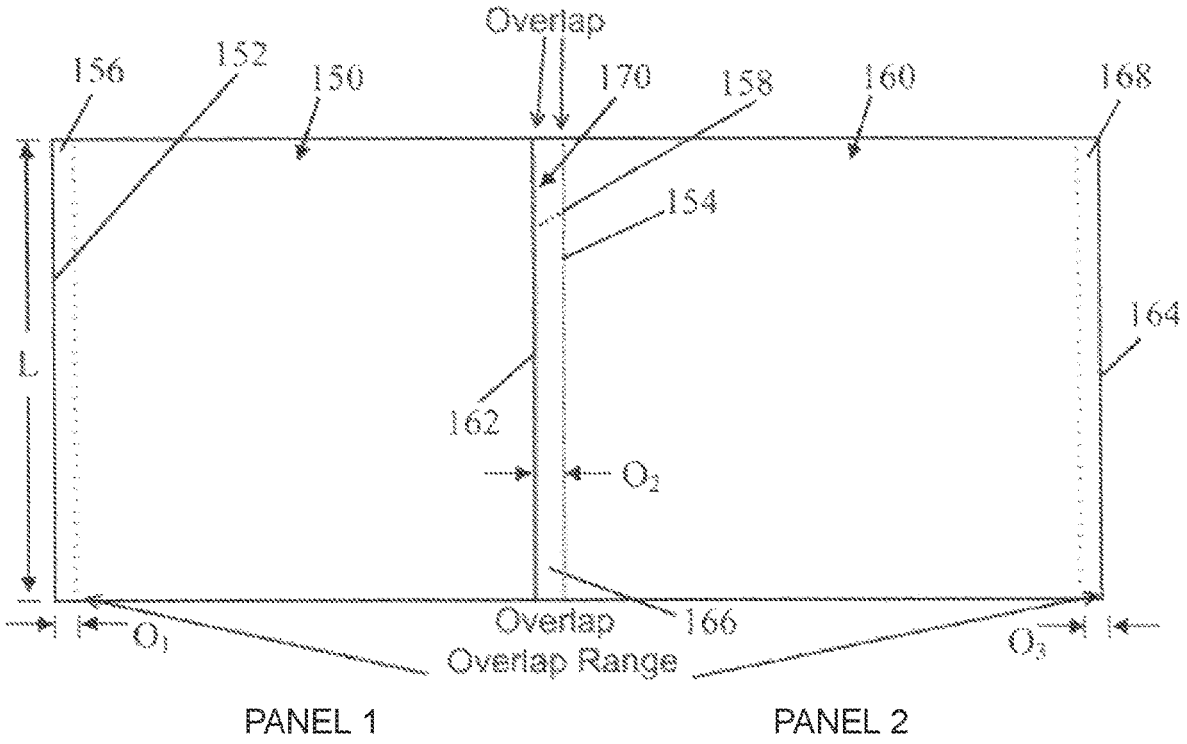
FIG. 27 illustrates an embodiment of panels having a camouflage pattern printed thereon that can be attached to a physical item according to the present subject matter.

As described above, the panels can be installed on a physical item, so that the panels overlap each other. FIG. 27 illustrates two panels generally designated 150, 160 that can be placed on a physical item such as a structure or a vehicle. When placed on the physical item, the two panels 150, 160 can have an overlap generally designated 170. Each panel can have a length L. As shown in FIG. 27, the length L for each panel 150, 160 can be the same; however, in other embodiments the lengths of the panels that are to be placed beside each other can have different lengths.

First panel 150 can have a first side 152 and a second side 154. A portion of each side 152, 154 can be designated as an overlap area 156, 158, respectively. The overlap areas 156 and 158 can run the length L of first panel 150. Overlap area 156 can have a width with a distance $0_1$ and overlap area 158 can have a width with a distance $0_2$. Distance $0_1$ and distance $0_2$ can be the same or different. Similarly, second panel 160 can have a first side 162 and a second side 164. A portion of each side 162, 164 can be designated as an overlap area 166, 168, respectively. The overlap areas 166 and 168 can run the length L of second panel 160. Overlap area 166 can have a width with a distance $0_2$ and overlap area 168 can have a width with a distance $0_3$. Distance $0_2$ and distance $0_3$ can be the same or different. Each overlap area 156, 158, 166, 168 can contain portions of the camouflage printed on the respective panels 150, 160.

First panel 150 can be installed with overlap area 156 overlapping another panel (not shown) or it can be applied directed to the physical item with no overlap. Once installed, the second panel 160 can be installed such that overlap area 166 of the second panel 160 extends over overlap area 158 of the first panel 150 to create overlap 170. This overlap 170 helps to ensure good coverage, for example, of the physical item on which the panels 150, 160 are placed. As described above, the distance $0_2$ of overlap 170 and the distances $0_1$, $0_3$ depend on factors that can include, for example, intended use, environment of use, the type and size of the physical item, and the type of substrate, laminate or ink used. The overlap 170 can range from about 0.75 inches to about 3 feet depending on the application and the factors listed above. Overlap area 168 of second panel 160 can overlap another panel (not shown). Alternatively, overlap area 168 of second panel 160 does not have to overlap another panel.

The camouflage patterns, the methods of making the same and the different materials or substrates on which they can be used provide various ways to create visual confusion and deception for the physical items on which they are applied.

Embodiments of the present disclosure shown in the drawings and described above are exemplary of numerous embodiments that can be made within the scope of the appending claims. It is contemplated that the configurations of the camouflage arrangements and related methods for making the same can comprise numerous configurations other than those specifically disclosed. The scope of a patent issuing from this disclosure will be defined by these appending claims.

What is claimed is:

1. A camouflage substrate, comprising:

a substrate; and a camouflage pattern applied to the substrate, the camouflage pattern including:

a photographic image;

a disruptive pattern applied to the photographic image, the disruptive pattern configured to obscure portions of foreground elements of the photographic image and including at least one color selected from a range of colors present in at least one of the photographic image and an operating environment in which the camouflage substrate is intended to be used; and a distortion applied to a portion of the photographic image, the distortion configured to inhibit depth perception of a viewer of the camouflage pattern.

2. The camouflage substrate of claim 1, wherein the distortion of the portion of the photographic image includes magnification or demagnification of the portion of the photographic image.

3. The camouflage substrate of claim 1, wherein the distortion of the portion of the photographic image includes having the portion of the photographic image out of focus.

4. The camouflage substrate of claim 1, wherein the camouflage pattern further includes a disruptive micropattern applied to the photographic image, the disruptive micropattern being smaller defined than the disruptive pattern.

5. The camouflage substrate of claim 4, wherein the disruptive micropattern-includes one or more additional colors selected from the range of colors, the one or more additional colors including colors not used in the disruptive pattern.

6. The camouflage substrate of claim 1, wherein the photographic image is one or more site-specific images of a specific local terrain, nautical position, or airspace where a physical item will be located or operating.

7. The camouflage substrate of claim 1, wherein the distortion of the portion of the photographic image includes a different focal length for the portion of the photographic image.

8. The camouflage substrate of claim 1, wherein the photographic image comprises a digital image.

9. The camouflage substrate of claim 1, wherein the substrate comprises at least one of a polyvinyl chloride film, a thermoplastic film, a mesh, a fabric, a knitted fabric, a woven fabric, and netting.

10. The camouflage substrate of claim 1, wherein the substrate is configured to be applied to a physical item.

11. The camouflage substrate of claim 10, wherein shading is added to the camouflage pattern based on an expected location of shadows for the physical item, wherein the expected location of shadows is based on a template of the physical item.

12. A method of creating a camouflage substrate, comprising:

providing a substrate; and applying, to the substrate, a camouflage pattern viewable on the substrate, the camouflage pattern including:

a photographic image;

a disruptive pattern applied to the photographic image, the disruptive pattern configured to obscure portions of foreground elements of the photographic image and including at least one color selected from a range of colors present in at least one of the photographic image and an operating environment in which the camouflage substrate is intended to be used; and a distortion applied to a portion of the photographic image, the distortion configured to inhibit depth perception of a viewer of the camouflage pattern.

13. The method of creating a camouflage substrate of claim 12, wherein the distortion of the portion of the photographic image includes magnification or demagnification of the portion of the photographic image.

14. The method of creating a camouflage substrate of claim 12, wherein the distortion of the portion of the photographic image includes having the portion of the photographic image out of focus.

15. The method of creating a camouflage substrate of claim 12, wherein the camouflage pattern further includes a disruptive micropattern applied to the photographic image, the disruptive micropattern being smaller than the disruptive pattern.

16. The method of creating a camouflage substrate of claim 15, wherein the disruptive micropattern includes one or more additional colors selected from the range of colors, the one or more additional colors including colors not used in the disruptive pattern.

17. The method of creating a camouflage substrate of claim 12, wherein the photographic image is one or more site-specific images of a specific local terrain, nautical position, or airspace where a physical item will be located or operating.

18. The method of creating a camouflage substrate of claim 12, wherein the distortion of the portion of the photographic image includes a different focal length for the portion of the photographic image.

19. The method of creating a camouflage substrate of claim 12, wherein the photographic image comprises a digital image.

20. The method of creating a camouflage substrate of claim 12, wherein the substrate comprises at least one of a polyvinyl chloride film, a thermoplastic film, a mesh, a fabric, a knitted fabric, a woven fabric, and netting.

21. The method of creating a camouflage substrate of claim 12, wherein the substrate is configured to be applied to a physical item.

22. The method of creating a camouflage substrate of claim 21, wherein shading is added to the camouflage pattern based on an expected location of shadows for the physical item, wherein the expected location of shadows is based on a template of the physical item.

* * * * *